US005381719A

United States Patent [19]

Otsuka

[11] Patent Number: 5,381,719

[45] Date of Patent: Jan. 17, 1995

[54] MUSIC REPRESENTING APPARATUS FOR FLOATING AN OBJECT ON THE BASIS OF A PERFORMANCE OF MUSIC

[75] Inventor: Toshihiko Otsuka, Oume, Japan

[73] Assignee: Casio Computer Co., Ltd., Tokyo, Japan

[21] Appl. No.: 994,143

[22] Filed: Dec. 21, 1992

[30] Foreign Application Priority Data

Dec. 27, 1991 [JP] Japan ..... 3-345976
Aug. 21, 1992 [JP] Japan ..... 4-222978

[51] Int. Cl.[6] ..... G10H 7/00

[52] U.S. Cl. ..... 84/600; 84/626; 446/179

[58] Field of Search ..... 84/600, 626, 627, 633, 84/725, 738, 741, 743; 446/179

[56] References Cited

U.S. PATENT DOCUMENTS 4,088,051 5/1978 Ellen ..... 84/331
4,121,490 10/1978 Deutsch ..... 84/626
4,196,650 4/1980 Fricke et al. ..... 84/687
4,556,392 12/1985 Chang ..... 446/16
4,955,840 9/1990 Moomaw ..... 446/17
5,042,819 8/1991 LaFata ..... 446/16 X

FOREIGN PATENT DOCUMENTS 4-3791 1/1992 Japan .

*Primary Examiner*—William M. Shoop, Jr.
*Assistant Examiner*—Jeffrey W. Donels
*Attorney, Agent, or Firm*—Frishauf, Holtz, Goodman & Woodward

[57] ABSTRACT

A blower provided, for example, at the bottom of a predetermined concavity in an electronic keyboard instrument supplies an air blast to a light ball to blow same up, using a fan rotated by a motor. In this case, a motor controller controls the rotational speed of the motor on the basis of the amplitude of a tone signal output from an amplifier. As a result, the ball moves up and down in accordance with the amplitude of the tone signal. The motor controller may control the rotational speed of the motor on the basis of a pitch for controlling the generation of a tone signal, velocity, timbre, automatic performance tempo, rhythm pattern or a change in the pitch or a combination of some or all of them, and not on the basis of the amplitude of the generated tone signal by itself.

22 Claims, 41 Drawing Sheets

| PITCH \ TIMBRE | A | B | C |
|---|---|---|---|
| HIGH | 5 | 4 | 3 |
| MEDIUM | 4 | 3 | 2 |
| LOW | 3 | 2 | 1 |

MUSIC REPRESENTING APPARATUS FOR FLOATING AN OBJECT ON THE BASIS OF A PERFORMANCE OF MUSIC

BACKGROUND OF THE INVENTION

1. Field of the Invention

The present invention relates to apparatus and process which visually represent a piece of music to be performed.

2. Description of the Related Art

It is said that performance of an musical instrument should preferably be learned since infancy. Unless the infant itself takes interest in the instrument, exercise would not continue so long whenever it exercises and it would soon feel bored, so that however much its parent may try to persuade it to do the effect of its learning does not improve. Therefore a scheme should be devised for causing the infant to feel it delightful to play a musical instrument.

There are conventionally devices in which when learner performs a melody on an electronic musical instrument, LEDs are lighted or voice such as "do", "re", "mi", "fa", etc., are produced in correspondence to the depressed keys. Those devices are suitable for telling the learner a key to be depressed or for the performer to memorize the note name of the depressed key. However, they are not necessarily delightful for infants.

Although, conventionally, music is, of course, one which human being enjoys acoustically, it could widely be used in the form of an interior device if the music is visually enjoyed as well.

SUMMARY OF THE INVENTION

It is an object of the present invention to provide a music representing apparatus which the listeners can enjoy visually.

In order to achieve the above object, the present invention provides a music representing apparatus comprising:

tone generating means for generating a tone signal on the basis of performance data;

object driving means for moving a predetermined object by applying a force to the object; and control means for controlling a state of the force which the object driving means applies to the object on the basis of at least one of the performance data and data on a characteristic of the tone signal generated by the musical tone generating means.

According to this apparatus, the tone generating means generates a tone signal on the basis of performance data, for example, input by performance or read out of a memory. The object driving means moves the predetermined object in accordance with the performance data or in correspondence to the characteristic of the generated tone signal, for example, the volume of the tone signal, so that the listener can visually enjoy the music as the move of the object.

In a first aspect of a music representing apparatus according to the present invention, tone generating means is provided for generating a tone signal on the basis of the performance data.

Object driving means is provided for blowing up the object with air blast.

Control means is provided for controlling the state of the air blast in the object driving means on the basis of the characteristic of the tone signal generated by the tone generating means. The control means provides control such that, for example, the intensity of air blast in the object drive means increases when the volume of the tone signal which is the characteristic of the tone signal is larger while the intensity of the air blast in the object drive means decreases when the volume of the tone is smaller. Alternatively, the control means may also provide control such that, for example, the intensity of the air blast in the object drive means increases when the volume of the tone signal is smaller while the intensity of the air blast in the object drive means decreases when the volume of the tone signal is larger.

According to the first aspect, the blown-up state of the object blown up by the object driving means changes on the basis of the characteristic or reverse characteristic of the tone signal generated by the tone generating means changes in accordance with the generation of the tone signal from the tone generating means.

In a second aspect of the present invention, in addition to tone generating means and object driving means similar in function to those in the first aspect, control means is provided for controlling a state of air blast in the object driving means on the basis of the performance data.

In the second aspect, the performance data which the control means refers to is data on the pitch of a tone, data on velocity indicative of the strength of key depression, data on the timbre of the tone, data on pitch bend indicative of a quantity of change in the pitch of the tone, data on the tempo of automatic performance or data on the rhythm pattern or a combination of at least two pieces of those data.

According to the second aspect, the blown-up state of the object blown up by the object driving means changes on the basis of the performance data which controls the generation of the tone in accordance with the generation of the tone signal from the tone generating means. More specifically, the object moves up and down as if it danced in the air in accordance with the volume and pitch of the tone, the intensity of key depression, the timber or tempo of the tone or a quantity of change in the pitch. Thus, the listener can keep time to the up and down movement of the object or conversely he can enjoy the up and down movement of the object to the intensity of key depression.

In a third aspect of the present invention, in addition to tone generating means, object driving means and control means similar to those in the first aspect, control means is provided for controlling the state of air blast in the object driving means in accordance with the kind of the performance data input to the tone generating means in addition to the characteristic of the tone. The performance data at this time is, for example, timbre designating data which designates the timbre of a tone which the tone generating means generates, and performance form designating data which designates the form of manual performance, automatic performance or automatic accompaniment in the tone generating means.

According to the third aspect, even if the level of generation of the tone signal changes depending on the timbre of the tone or the form of the performance when the blown-up state of the object changes as in the first aspect, the control means controls the height to which the object is blown up on the basis of the performance data to avoid an excessive or insufficient height of the blown-up object.

In a fourth aspect of the present invention, in addition to tone generating means, object driving means, and control means are provided which are similar to those in the first aspect. The object driving means comprises electrical driving means which feeds air blast. A signal representing a drive state of the electrical drive means is fed back to the control means. The control means controls the state of the air blast in the electrical driving means in accordance with both the characteristic of the tone signal and the signal representing the driving state of the electrical driving means. The signal representing driving state of the electrical driving means is, for example, the driving speed of the electrical driving means detected by driving speed detecting means.

According to the fourth aspect, even if the generation level of the tone signal changes depending on the timbre and/or performance form of the tone when the blown-up state of the object changes as in the first aspect, the control means controls the state of the air blast in the object driving means in accordance with the signal representing driving state of the electrical driving means such that the object is not excessively high or low blown up.

In a fifth aspect of the present invention, in addition to tone generating means, object driving means and control means similar to those in the first aspect, envelope extracting means is further provided for extracting the envelope of a tone signal generated by the tone generating means. The control means controls the object drive means such that the object drive means moves the object in a predetermined direction when the envelope value extracted by the envelope extracting means is larger than a predetermined value and such that the object drive means moves the object in a direction opposite to said predetermined direction when the extracted envelope value is smaller than the predetermined value.

According to the fifth aspect, when the envelope value of the tone is larger than the predetermined value, the object drive means blows up the object while when the envelope value is less than the predetermined value, the object drive means draws the object. Therefore, the move of the object is greatly large and dynamic compared to the first aspect.

In a sixth aspect of the present invention, in addition to tone generating means, object driving means and control means similar to those in the first aspect, effect adding means is provided for adding an effect such as an echo effect to the characteristic of the tone signal generated by the tone generating means. The control means controls the state of air blast in the object drive means on the basis of the characteristic of the tone such as the amplitude of the tone to which an effect such as an echo effect produced by the effect adding means is added.

According to the sixth aspect, the control means controls the object drive means not in direct accordance with the characteristic of the tone signal generated the tone generating means, but in accordance with the volume characteristic of the tone signal to which the effect adding means has added an effect, for example, such as echo. As a result, the height to which the object is blown up changes complicatedly compared to first aspect.

In a seventh aspect of the present invention, in addition to object drive means similar that in the first aspect, the control means is provided for controlling the state of air blast in the object drive means on the basis of the characteristic of an acoustic signal received from an external electronic musical instruments.

Thus, the blown-up state of the object which is blown up by the object driving means changes.

In an eighth aspect of the present invention, in addition to object driving means similar to that in the first aspect, control means is provided for controlling the state of air blast in the object driving means on the basis of performance data received from an external electronic musical instrument or the like in accordance with MIDI (Musical Instrument Digital Interface) standards.

Therefore, according to the eighth aspect, the blown-up state of the object blown up by the object driving means changes as in the second aspect.

In the first-eighth aspects of the present invention, guide means, for example, including a transparent case for guiding the object blown up by the object driving means is further provided to thereby blow the object up in a stabilized manner.

In a ninth aspect of present invention, tone generating means is provided which is similar to that the first aspect.

Also, object drive means is provided for changing the state of a magnetic field, for example, for pushing up a magnet placed in a transparent tube in a repellent manner. The object drive means, for example, comprises an electromagnetic solenoid which produces a magnetic field due to an electrical current flowing through a coils of the solenoid.

The magnet may take the form of a plurality of magnets placed in the corresponding transparent capsules which are filled with a transparent liquid.

Control means is provided for controlling the object drive means such that the object drive means changes the state of the magnetic field on the basis of the characteristic of the tone produced by the tone generating means.

According to the ninth aspect, by flowing an electric current corresponding to the characteristic. for example, a volume, of a tone signal through the coils of the electromagnetic solenoid, the height to which the magnet is pushed up by the repellant force occurring between the solenoid and the magnet changes. When the volume of the tone is larger, the magnet is higher pushed up while when the volume is smaller, the magnet is lower pushed up.

When the magnets are placed in capsules received the corresponding transparent tubes which are each filled with a transparent liquid, the weight of the capsules containing the magnets is reduced by the buoyancy of the capsules. Thus, the magnets are pushed up to the same height with a greatly low repellant force compared to the case where the magnets are placed in the tubes which contain no liquid. The magnets also moves slowly up and down in accordance with changes in the volume of the tone signal because of viscous and form drags to the capsules.

In a tenth aspect of the present invention, tone generating means is provided similar to that in the first aspect.

Soap bubble solution film producing means is provided, for example, for producing a soap bubble solution film from a soap bubble solution. This means produces cylinder-like soap bubble solution films, for example, by dipping part of a metal net cylinder rotated by a motor into a soap bubble solution having high viscosity such as soap water.

Blower means is provided, for example, for producing soap bubbles by feeding air blast using a motor to a soap bubble solution film produced by the soap bubble solution film producing means.

Soap bubble solution film control means is provided for controlling the state of production of bubble soap solution films in the bubble solution film producing means on the basis of the characteristic of a tone generated by the tone generating means. The bubble solution film controlling means, for example, controls the rotational speed of the motor for rotating the net cylinder, mentioned above.

Blower control means is provided for controlling the state of air blast in the blower means on the basis of the characteristic of the tone signal generated by the tone generating means. The blower control means controls the state of air blast by controlling the rotational speed of the blower motor.

According to the tenth aspect, the state of the soap bubbles produced by the blower means and the soap bubble solution film producing means changes on the basis of the characteristic of the tone signal generated by the tone generating means in accordance with the generation of the tone generation means.

When the present invention is applied, for example, to an electronic musical instrument, performance means may be further provided for generating the performance data by performance.

When the present invention is applied, for example, to an interior device, automatic performance means may be further provided for generating performance data automatically.

Of course, an electronic musical instrument including both of performance operation means and automatic performance means falls within the scope of the present invention.

According to the present invention, a music representing apparatus is realized as an electronic musical instrument, for example, for infants or an interior device which is greatly different from the conventional electronic musical instruments.

Further, the present invention provides a music representing process comprising the steps of:

generating a tone signal on the basis of performance data;

moving a predetermined object by applying a force to the object; and controlling the state of the force applied to said object on the basis of at least one of the performance data and data on a characteristic of the tone signal generated.

Other objects and structures of the present invention will be understood by reading the following detailed description of the preferred embodiments of the present invention with reference to the accompanying drawings.

DETAILED DESCRIPTION OF THE PREFERRED EMBODIMENTS

Figure 1A:
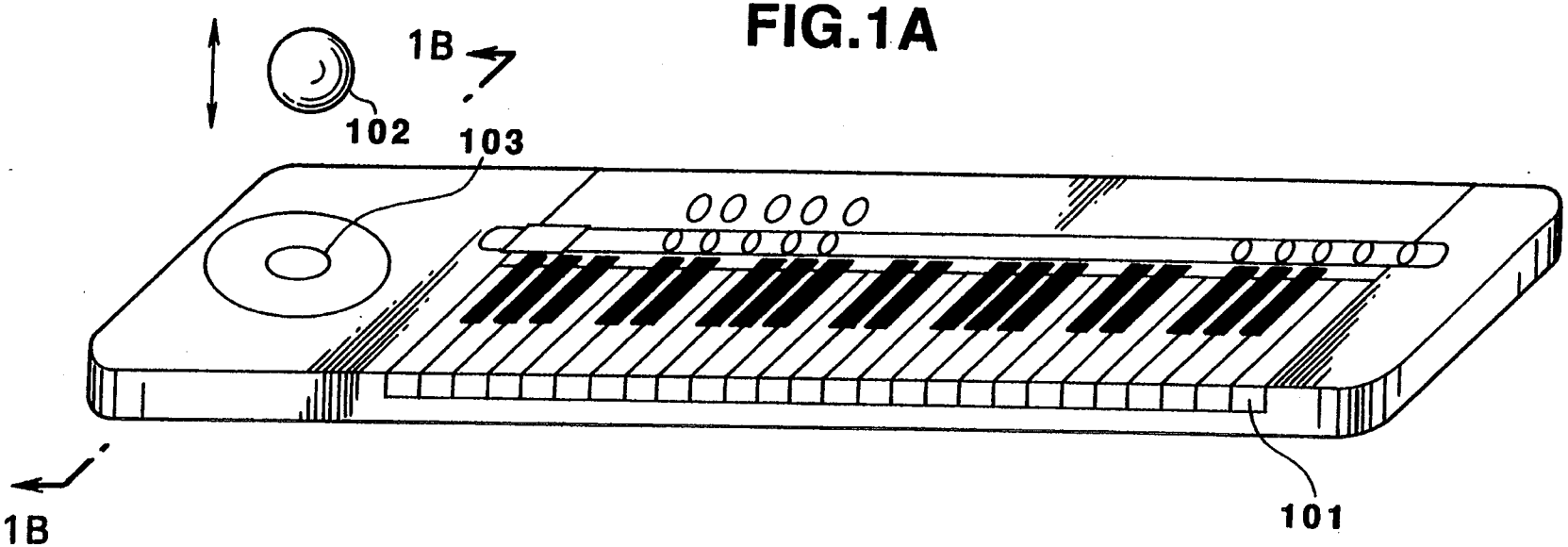
FIGS. 1A and B show the appearance of an embodiment of a music representing apparatus according to the present invention.

Referring to the drawings, 18 embodiments of a music representing apparatus and process according to the present invention applied to an electronic keyboard instrument will be described below. The appearances of a first—a thirteenth embodiment of the instrument are all the same and shown in FIG. 1A with the number of keys of the instrument being 44 (F2–C6).

Figure 1B:
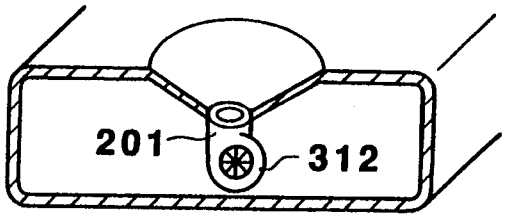
Figure 2A:
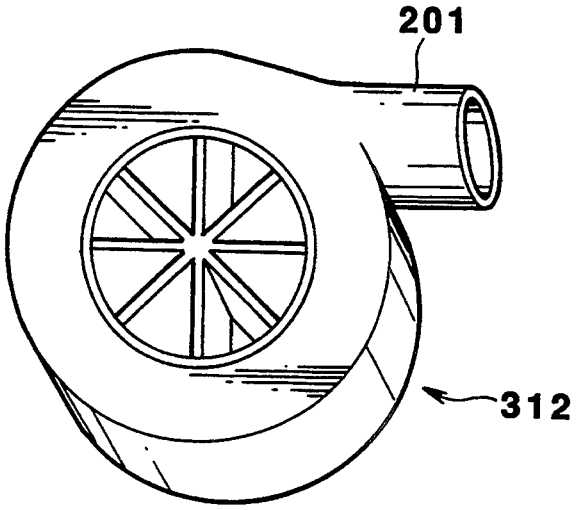
FIGS. 2A and B show the appearance of a fan and a duct, respectively, of the first embodiment.
Figure 2B:
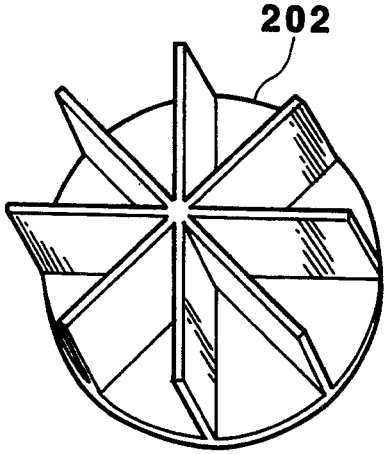

In FIG. 1A, the instrument has a concavity as shown in FIG. 1B which is a cross-sectional view taken along the line 1B—1B of FIG. 1A. Fan 202 rotated by DC motor 312 as shown in FIG. 2B feeds air blast from duct 201 as shown in FIG. 2B through blower hole 103 provided in the bottom of the concavity to blow light ball 102 up.

The height to which ball 102 is blown up is determined by the pressure of the air blast, so that ball 102 is moved up and down in accordance with a change in performance data by controlling the pressure of air blast on the basis of performance data such as volume, pitch, velocity, timbre, rhythm pattern, tempo or pitch change by pitch bender of a tone or a combination of some of them.

The respective embodiments will be below described sequentially.

First Embodiment

<Structure>

In the present embodiment, the height to which ball 102 is blown up changes depending on the volume of a tone performed.

Figure 3:
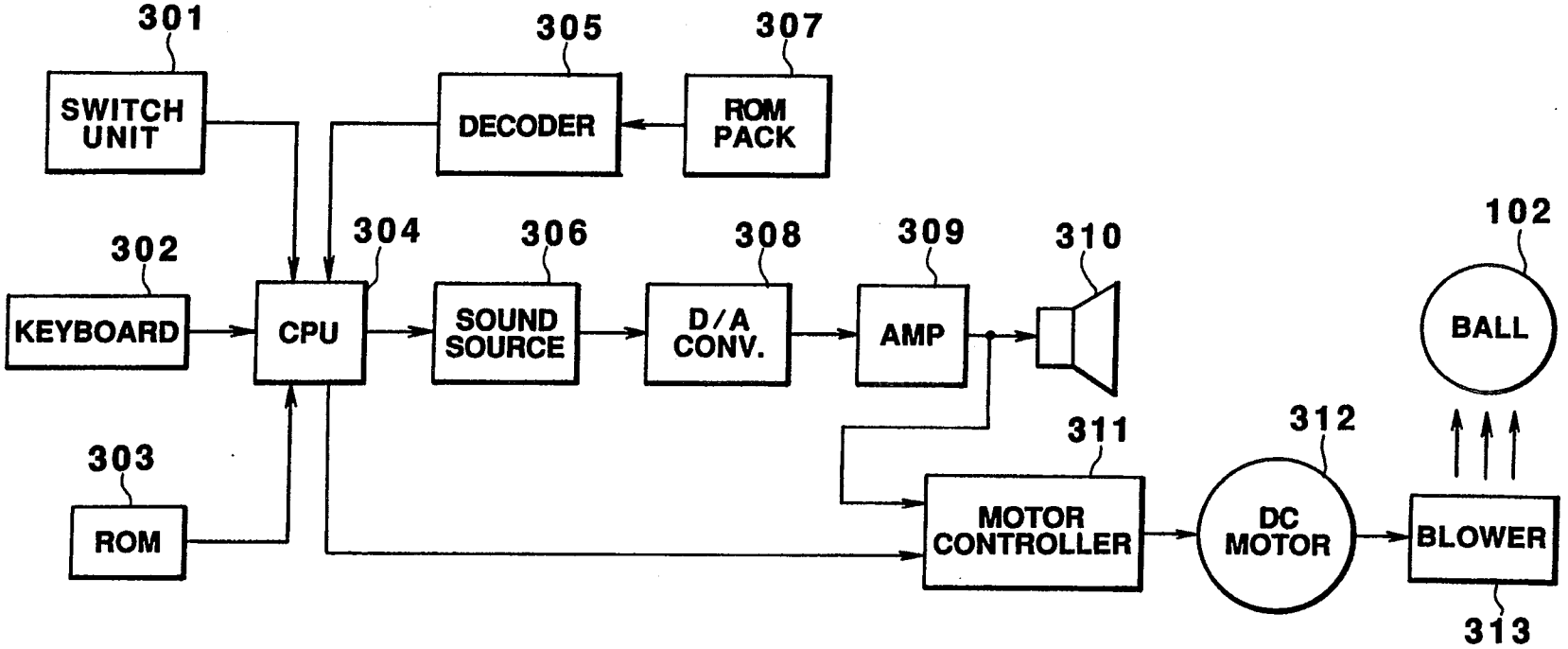
FIG. 3 shows the overall structure of the first embodiment.

FIG. 3 is a block diagram of the overall structure of the present embodiment of the music representing apparatus. In FIG. 3, first, CPU (Central Processing Unit) 304 controls the respective other elements concerned of the instrument in accordance with programs stored in a ROM (Read Only Memory).

Switch unit 301 is composed of various switches required for performance.

Performance data output from keyboard 302 (the same as keyboard 101 of FIG. 1) played by the performer or performance data, for example, for automatic accompaniment, read out of ROM 307 and decoded by decoder 505 is input to CPU 304. Under control of CPU 304, sound source 306 produces a tone signal having a predetermined pitch, timbre and amplitude envelope, and the signal is converted by D/A converter 308 to an analog tone signal, which is then generated a tone from speaker 310 through amplifier 309.

Simultaneously with the generating of the tone from speaker 310, motor controller 311 controls the rotational speed of DC motor 312 in accordance with the amplitude envelope or volume of the tone signal output from amplifier 309. As a result, ball 102 is blown up by air blast from blower 313 (the same as duct 201 of FIG. 2A). In this case, the user can adjust motor controller 311 with a knob on switch unit 301 through CPU 304.

Figure 4:
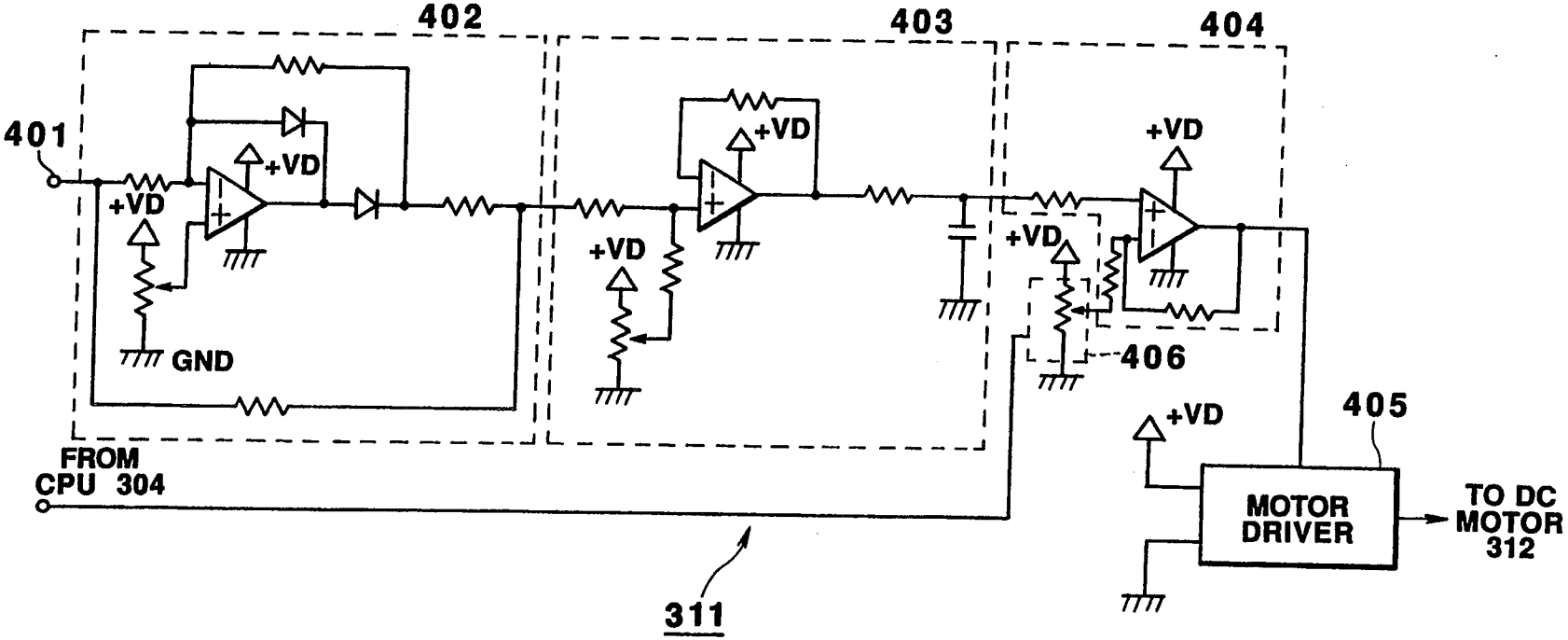
FIG. 4 is a circuit diagram of a motor controller of the first embodiment.

FIG. 4 shows the circuit of motor controller 311. A tone signal from amplifier 309 of FIG. 3 enters through input terminal 401 of FIG. 4 to well-known full-wave rectifier 402 where it is full-wave rectified by rectifier 402 and smoothed by well-known LPF (Low Pass Filter) 403. As a result, a DC voltage is obtained corresponding to the amplitude envelope of the tone signal. DC amplifier 404 amplifies this DC voltage to thereby provide a DC voltage corresponding to the amplitude envelope or volume of the tone signal. Motor driver composed of a power amplifier 405 power amplified the DC voltage, and the resulting signal is fed to DC motor 312.

In this case, in order to adjust the height to which ball 102 is blown up, it is necessary to adjust the pressure of air blast from blower 313 (duct 201). To this end, when the user adjusts a particular knob on switch unit 301 of FIG. 3, CPU 304 delivers a control voltage corresponding to a quantity of manipulation of the knob to electronic variable resistor 406 connected to DC amplifier 404 to thereby control an offset voltage in DC amplifier 404.

<Operation>

By the above construction, the rotational speed of DC motor 312 changes in accordance with the amplitude envelope of the tone signal from sound source 304 or the volume of the tone on the basis of performance data from keyboard 302 or ROM pack 307.

As a result, as mentioned above, ball 102 is higher blown up when the volume is larger while the ball is lower blown up when the volume is smaller.

Overall Common Structure of Second-Eighth Embodiments

Figure 5:
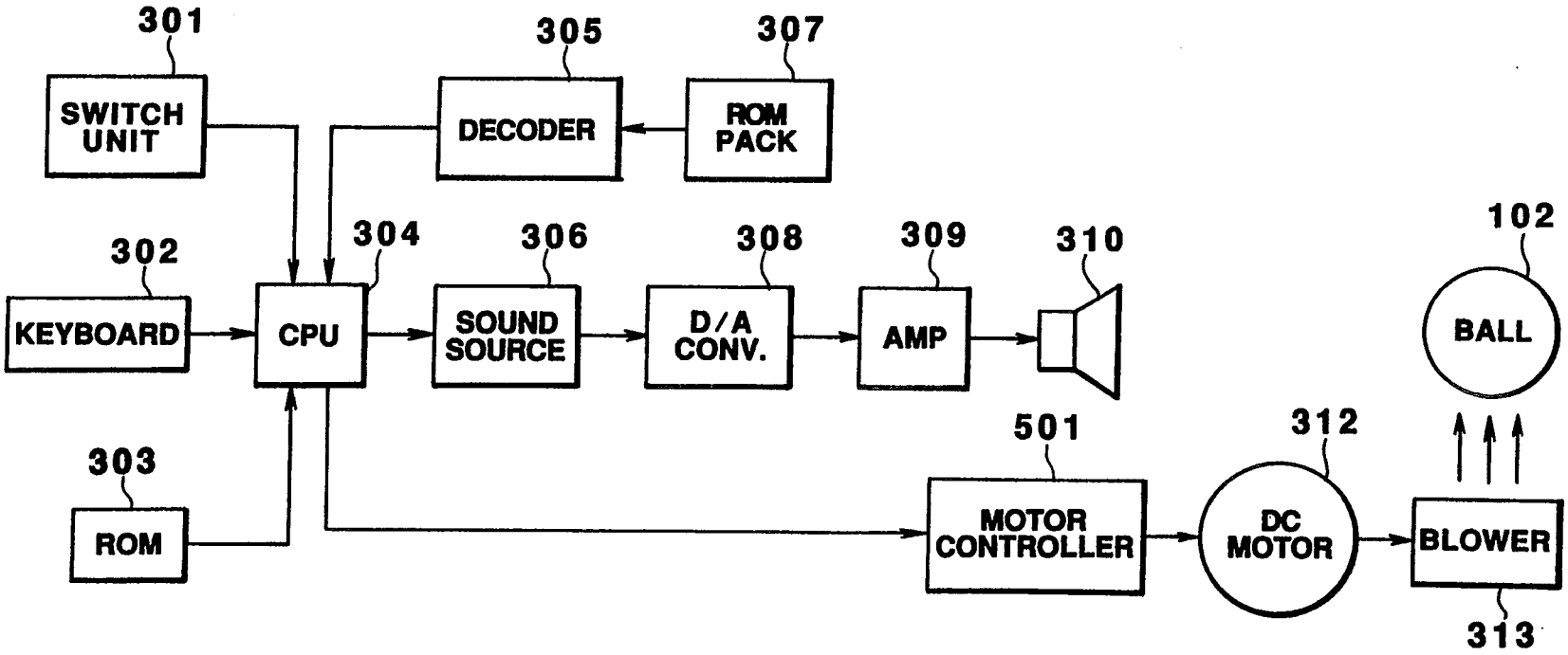
FIG. 5 shows the overall structure of a second-an eighth embodiment of the present invention.

Next, the second-eighth embodiments will be described, which are the same in overall structure, as shown in FIG. 5.

The structure of the embodiments of FIG. 5 is substantially the same as that of the FIG. 3 first embodiment, and the same numeral denotes elements having the same function in FIG. 5 and 3.

The arrangement of FIG. 5 is different from that of FIG. 3 in that motor controller 501 (corresponding to 311 of FIG. 3) changes the drive voltage of DC motor 312 not in accordance with a tone quantity signal of the tone signal output from amplifier 309, but in accordance with performance data, for example, data on pitch (key number), velocity, timbre, rhythm pattern, tempo, pitch change by pitch bender or a combination of some or all of them.

Figure 6:
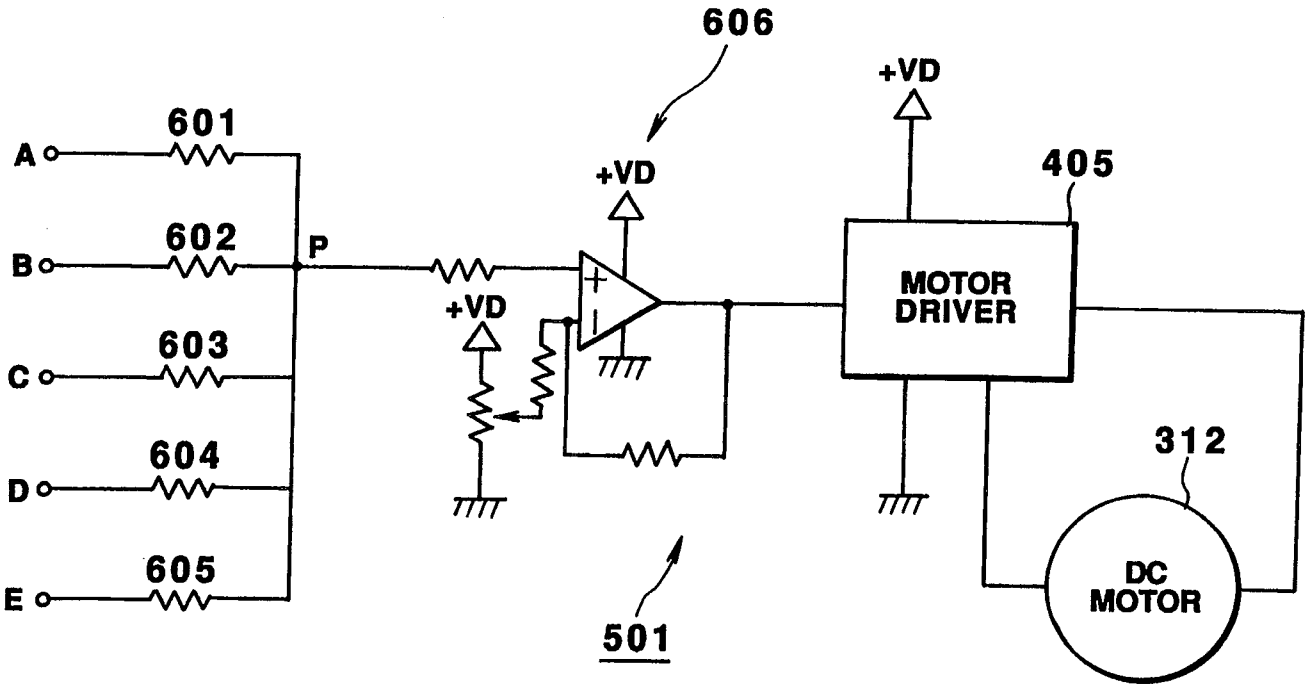
FIG. 6 shows a circuit diagram of the motor controller of the second-eighth embodiments.

FIG. 6 shows the circuit of motor controller 501.

CPU 304 of FIG. 5 first selects input terminal A, B or C in motor controller 501 (FIG. 6) in accordance with performance data from keyboard 302 or from ROM pack 307 through decoder 305 and applies a DC control voltage to the selected input terminal. The DC voltage (at point of FIG. 6) input to DC voltage amplifier 606 based on the control voltage changes depending on the value of the selected one of resistors 601, 602 and 603. Resistors 601, 602 and 603 are set, for example to 20, 50 and 100 kΩ, respectively, in the second-seventh embodiments. In this case, the voltage at point P is highest when input terminal A is selected, medium when input terminal B is selected, and lowest when input terminal C is selected. Resisters 604, 605 of FIG. 6 will be described in the eighth embodiment to be described later in more detail.

DC voltage amplifier 606 amplifies the voltage at point P, the output from amplifier 606 is further power amplified by motor driver 405 comprising a power amplifier and the output from which drives DC motor 312. Fan 202 attached to the rotational shaft of DC motor 312 feeds air to blower hole 103 of FIG. 1A.

As a result, a control voltage is applied to the input terminal which CPU 304 has selected on the basis of the performance data output from keyboard 302 or ROM pack 307, so that the pressure of air blast in blower hole 103 and hence the height to which ball 102 is blown up change.

The respective operations of the second-eight embodiment based on the FIG. 5 structure will be described below.

Operation of the Second Embodiment

In the present embodiment, the height to which ball 2 is blown up changes in accordance with pitch data (key number) of the performance data input to CPU 304.

Figure 7:
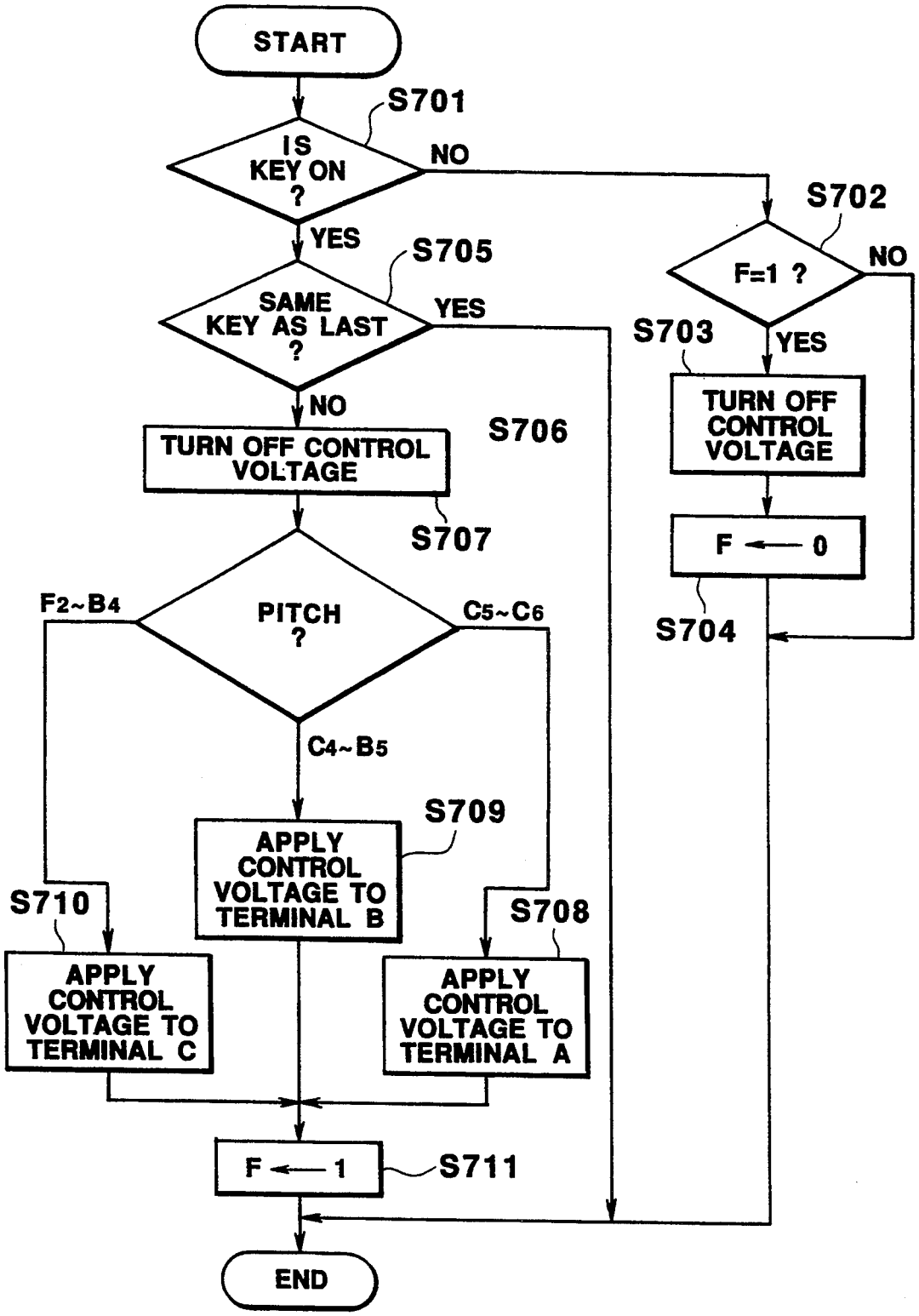
FIG. 7 is an operation flowchart for the second embodiment.

FIG. 7 is an operation flowchart for the second embodiment realized as the operation of CPU 304 of FIG. 5 which executes a control program stored in ROM 303.

First, CPU 304 determines whether a key on keyboard 302 is on (depressed) (step S701).

If NO at step S701, CPU 304 determines whether "1" (indicative of the depression of a key) is set in key depression flag F (step S702).

If NO at step S701, nothing is executed. If YES at step S701, CPU 304 turns off its control voltage fed to motor controller 501 (step S703) and then sets "0" in flag F (step S704).

If at step S701 CPU 304 determines that a key is depressed, it determines at step S705 whether the same key as that depressed last is depressed.

If so, nothing is executed. If not, CPU 304 temporarily turns off the control voltage output therefrom (step S706).

CPU 304 then determines the pitch of a tone for the depressed key (step S707). If the pitch (key number) of the depressed key corresponds to the pitch of note names C5 and C6, the control voltage is applied to input terminal A of FIG. 6 in motor controller 501 (step S708). If the key number corresponds to the pitch of note names C4–B5, the control voltage is applied to input terminal B (step S709). If the key number corresponds to the pitch of the note names F2–B4, the control voltage is applied to input terminal C (step S710).

Thereafter, CPU 304 sets "1" in flag F to thereby indicate key depression (step S711).

As just described above, CPU 304 applies the control voltage to its selected input terminal on the basis of the pitch data of the performance data output from keyboard 302 or ROM pack 307 to change the output voltage from motor controller 501 and hence the rotational speed of DC motor 312. Therefore, the pressure of air blast from the blower 313 (duct 201) changes in high, medium and low levels and hence the height to which ball 2 is blown up changes.

Operation of the Third Embodiment

In the present embodiment, the height to which ball 2 is blown up changes in accordance with velocity data (key depression data) of the performance data input to CPU 304.

Figure 8:
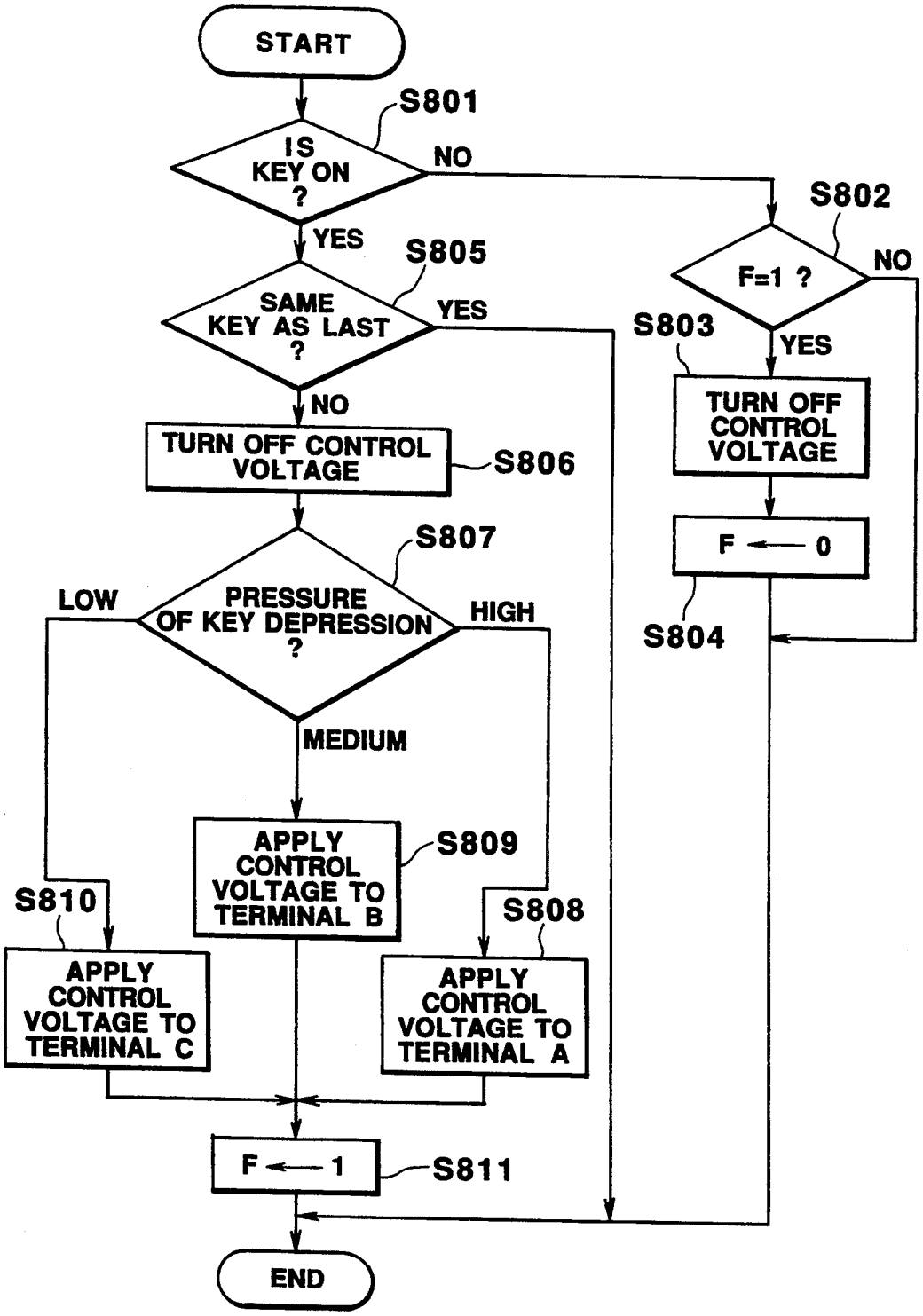
FIG. 8 is an operation flowchart for the third embodiment.

FIG. 8 is an operation flowchart of the third embodiment realized as the operation of CPU 304 of FIG. 5 which executes a control program stored in ROM 303.

First, CPU 304 determines whether a key on key board 302 is on (depressed) (step S801).

If NO at step S801, CPU 304 determines whether "1" (indicative of the depression of a key) is set in key depression flag F (step S802).

If NO at step S801, nothing is executed. If YES at step S801, CPU 304 turns off its control voltage fed to motor controller 501 (step S803) and then sets "0" in flag F (step S804).

If at step S801 CPU 304 determines that a key is depressed, it determines at step S805 whether the same key as that depressed last is depressed.

If so, nothing is executed. If not, CPU 304 temporarily turns off the control voltage output therefrom (step S806).

CPU 304 then determines the depression pressure of the depressed key (step S807). If the depression pressure of the depressed key is high, the control voltage is applied to input terminal A (step S808). If the depression pressure is medium, the control voltage is applied to input terminal B (step S809). If the depression pressure is low, the control voltage is applied to input terminal C (step S810).

Thereafter, CPU 304 sets "1" in flag F to thereby indicate that a key is under depression (step S711).

As just described above, CPU 304 applies the control voltage to its selected input terminal on the basis of the pressure of the key depression (velocity) or the performance data output from keyboard 302 or ROM pack 307 to change the output voltage from motor controller 501 and hence the rotational speed of DC motor 312. Therefore, the pressure of air blast from the blower 313 (duct 201) changes in high, medium and low levels and hence the height to which ball 2 is blown up changes.

Operation of the Fourth Embodiment

In the present embodiment, the height to which ball 2 is blown up changes in accordance with timbre data of the performance data input to CPU 304. The timbre data shows that any one of three timbres "A", "B" and "C" is selected by a timbre select switch (not shown) in switch unit 301.

Figure 9:
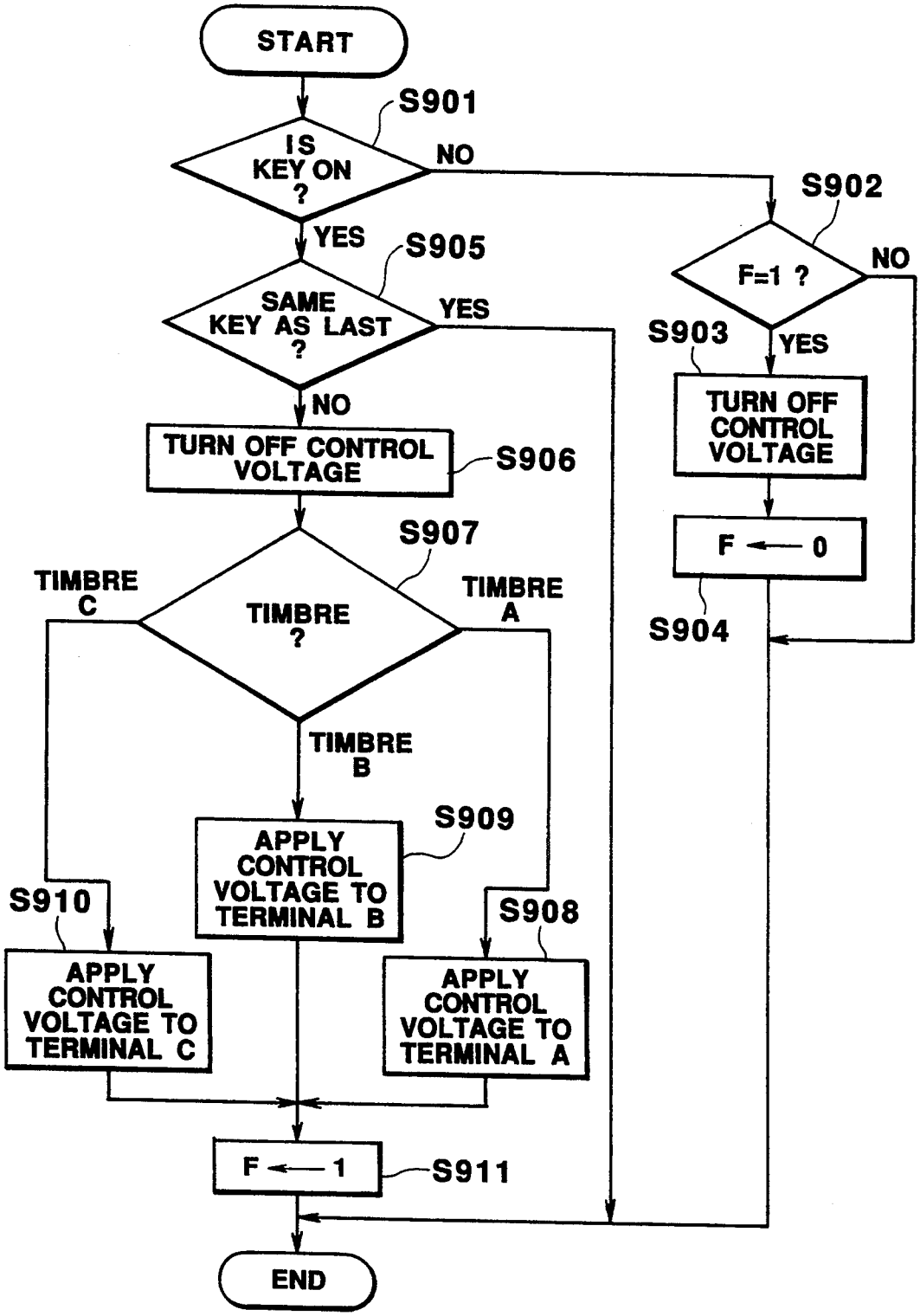
FIG. 9 is an operation flowchart for the fourth embodiment.

FIG. 9 is an operation flowchart of the fourth embodiment realized as the operation of CPU 304 of FIG. 5 which executes a control program stored in ROM 303.

First, CPU 304 determines whether a key on keyboard 302 is on (depressed) (step S901).

If NO at step S901, CPU 304 determines whether "1" (indicative of the depression of a key) is set in key depression flag F (step S902).

If NO at step S901, nothing is executed. If YES at step S901, CPU 304 turns off the control voltage fed to motor controller 501 (step S903) and then sets "0" in flag F (step S904).

If at step S901 CPU 304 determines that a key is depressed, it determines at step S905 whether the same key as that depressed last is depressed.

If so, nothing is executed. If not, CPU 304 temporarily turns off the control voltage output therefrom (step S906).

CPU 304 then determines the current selected timbre (step S907). If the selected timbre is "A", the control voltage is applied to input terminal A (step S908). If the timbre is "B", the control voltage is applied to input terminal B (step S909). If the timbre is "C" the control voltage is applied to input terminal C (step S910).

Thereafter, CPU 304 sets "1" in flag F to thereby indicate key depression (step S911).

As just described above, CPU 304 applies the control voltage to its selected input terminal on the basis of the timbre data selected by the timbre select switch in switch unit 301 to change the output voltage from motor controller 501 and hence the rotational speed of DC motor 312. Therefore, the pressure of air blast from the blower 313 (duct 201) changes in high, medium and low levels and hence the height to which ball 2 is blown up changes.

Operation of the Fifth Embodiment

In the present embodiment, when any one of three kinds of rhythm patterns "A", "B" and "C" for automatic performance stored in ROM pack 307 is selected and performed by a rhythm pattern select switch (not shown) in switch unit 301, the height to which ball 102 is blown up is changed in accordance with data from the rhythm pattern select switch input to CPU 304.

Figure 10:
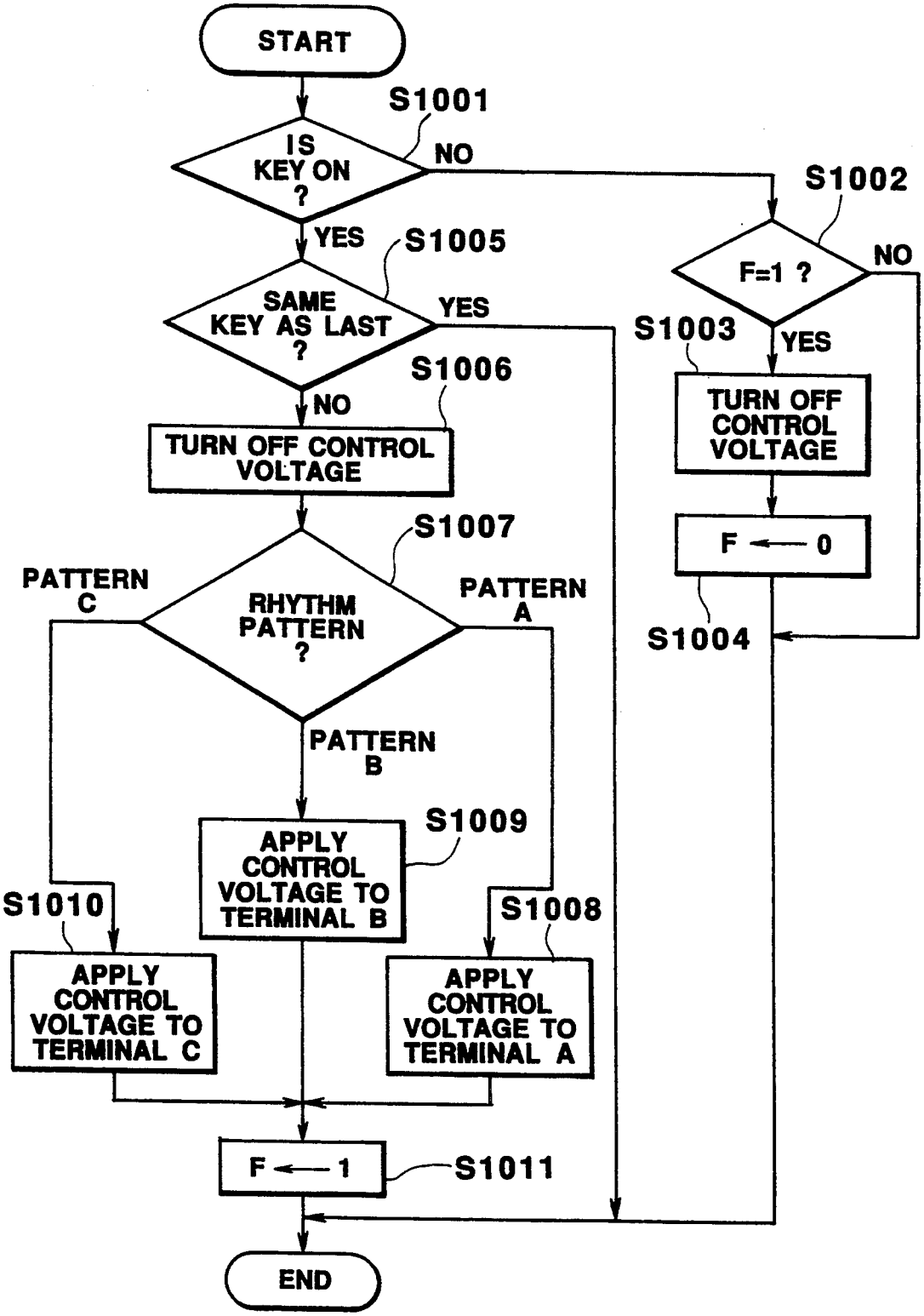
FIG. 10 is an operation flowchart for the fifth embodiment.

FIG. 10 is an operation flowchart of the fifth embodiment realized as the operation of CPU 304 of FIG. 5 which executes a control program stored in ROM 303.

First, CPU 304 determines whether a key on key board 302 is on (depressed) (step S1001).

If NO at step S1001, CPU 304 determines whether "1" (indicative of the depression of a key) is set in key depression flag F (step S1002).

If NO at step S1002, nothing is executed. If YES at step S1002, CPU 304 turns off its control voltage fed to motor controller 501 (step S1003) and then sets "0" in flag F (step S1004).

If at step S1001 CPU 304 determines that a key is depressed, it determines at step S1005 whether the same key as that depressed last is depressed.

If so, nothing is executed. If not, CPU 304 temporarily turns off the control voltage output therefrom (step S1006).

CPU 304 then determines the current performed rhythm pattern (step S1007). If the current rhythm pattern is "A", the control voltage is applied to input terminal A (step S1008). If the rhythm pattern is "B", the control voltage is applied to input terminal B (step S1009). If the rhythm pattern is "C", the control voltage is applied to input terminal C (step S1010).

Thereafter, CPU 304 sets "1" in flag F to thereby indicate key depression (step S1011).

As just described above, CPU 304 applies the control voltage to its selected input terminal on the basis of the rhythm pattern data output from switch unit to change the output voltage from motor controller 501 and hence the rotational speed of DC motor 312. Therefore, the pressure of air blast from the blower 313 (duct 201) changes in high, medium and low levels and hence the height to which ball 2 is blown up changes.

Operation of the Sixth Embodiment

In the present embodiment, when a rhythm for automatic performance stored in ROM pack 307 is performed in any one of three kinds of tempos "rapid", "medium" and "slow" by a tempo select switch (not shown) in switch unit 301, the height to which ball 102 is blown up is changed in accordance with data from the rhythm pattern select switch input to CPU 304.

Figure 11:
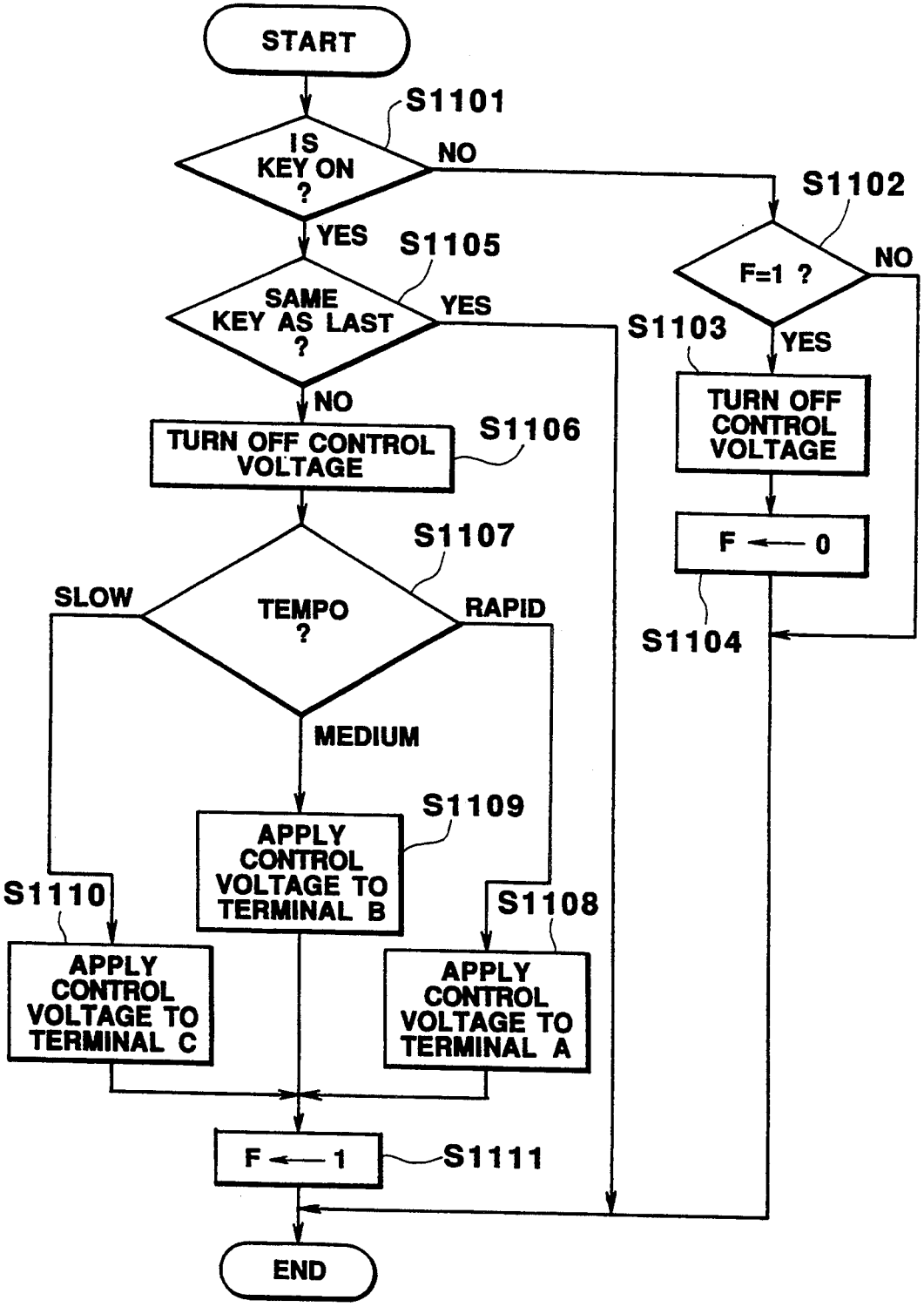
FIG. 11 is an operation flowchart for the sixth embodiment.

FIG. 11 is an operation flowchart of the sixth embodiment realized as the operation of CPU 304 of FIG. 5 which executes a control program stored in ROM 303.

First, CPU 304 determines whether a key on key board 302 is on (depressed) (step S1101).

If NO at step S1101, CPU 304 determines whether "1" (indicative of the depression of a key) is set in key depression flag F (step S1102).

If NO at step S1102, nothing is executed. If YES at step S1102, CPU 304 turns off its control voltage fed to motor controller 501 (step S1103) and then sets "0" in flag F (step S1104).

If at step S1101 CPU 304 determines that a key is depressed, it determines at step S1105 whether the same key as that depressed last is depressed.

If so, nothing is executed. If not, CPU 304 temporarily turns off the control voltage output therefrom (step S1106).

CPU 304 then determines the current performance data (step S1107). If the current tempo is "rapid", the control voltage is applied to input terminal A (step S1108). If the tempo is "medium", the control voltage is applied to input terminal B (step S1109). If the tempo is "low", the control voltage is applied to input terminal C (step S1110).

Thereafter, CPU 304 sets "1" in flag F to thereby indicate key depression (step S1111).

As just described above, CPU 304 applies the control voltage to its selected input terminal on the basis of the tempo data output from switch unit 301 to change the output voltage from motor controller 501 and hence the rotational speed of DC motor 312. Therefore, the pressure of air blast from the blower 313 (duct 201) changes in high, medium and low levels and hence the height to which ball 2 is blown up changes.

Operation of the Seventh Embodiment

In the present embodiment, when a pitch change quantity is changed in any one of ranges of "more than + a halftone", "within ± a halftone" and "less than − a halftone" by a pitch bender (not shown) in switch unit 301, the height to which ball 102 is blown up is changed in accordance with the pitch change quantity input to CPU 304.

Figure 12:
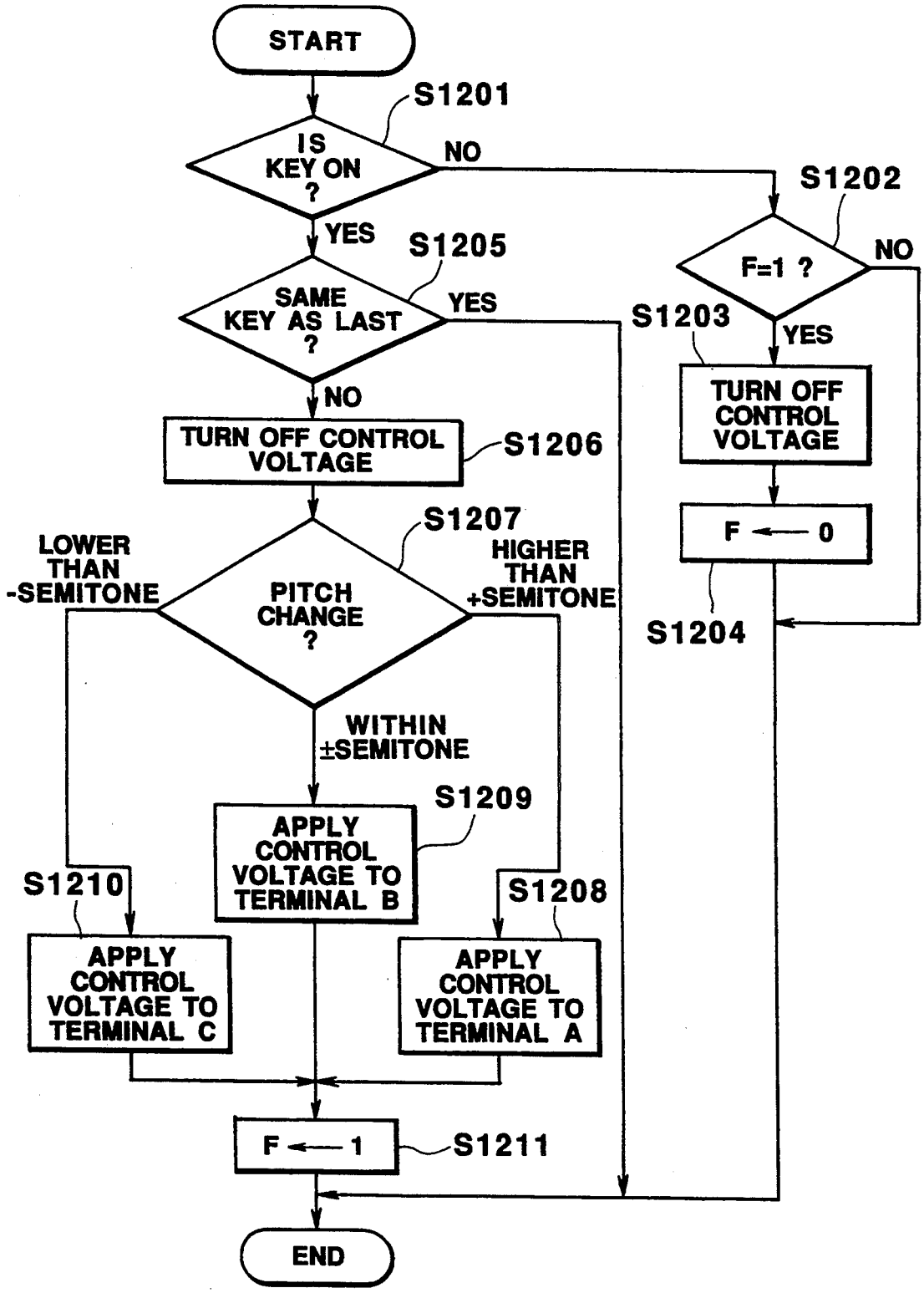
FIG. 12 is an operation flowchart for the seventh embodiment.

FIG. 12 is an operation flowchart for the seventh embodiment realized as the operation of CPU 304 of FIG. 5 which executes a control program stored in ROM 303.

First, CPU 304 determines whether a key on key board 302 is on (depressed) (step S1201).

If NO at step S1201, CPU 304 determines whether "1" (indicative of the depression of a key) is set in key depression flag F (step S1202).

If NO at step S1202, nothing is executed. If YES at step S1202, CPU 304 turns off its control voltage fed to motor controller 501 (step S1203) and then sets "0" in flag F (step S1204).

If at step S1201 CPU 304 determines that a key is depressed, it determines at step S1205 whether the same key as that depressed last is depressed.

If so, nothing is executed. If not, CPU 304 temporarily turns off the control voltage output therefrom (step S1206).

CPU 304 then determines the pitch change quantity by the pitch bender (step S1207). If the pitch change quantity is "more than + a halftone", the control voltage is applied to input terminal A (step S1208). If the pitch change quantity is "within ± a halftone", the control voltage is applied to input terminal B (step S1209). If the pitch change quantity is "less than− a halftone", the control voltage is applied to input terminal C (step S1210).

Thereafter, CPU 304 sets "1" in flag F to thereby indicate key depression (step S1211).

As just described above, CPU 304 applies the control voltage to its selected input terminal on the basis of the pitch change quantity by the pitch bender output from switch unit 301 to change the output voltage from motor controller 501 and hence the rotational speed of DC motor 312. Therefore, the pressure of air blast from the blower 313 (duct 201) changes in high, medium and low levels and hence the height to which ball 2 is blown up changes.

Operation of Eighth Embodiment

Figures 13A, 13B:
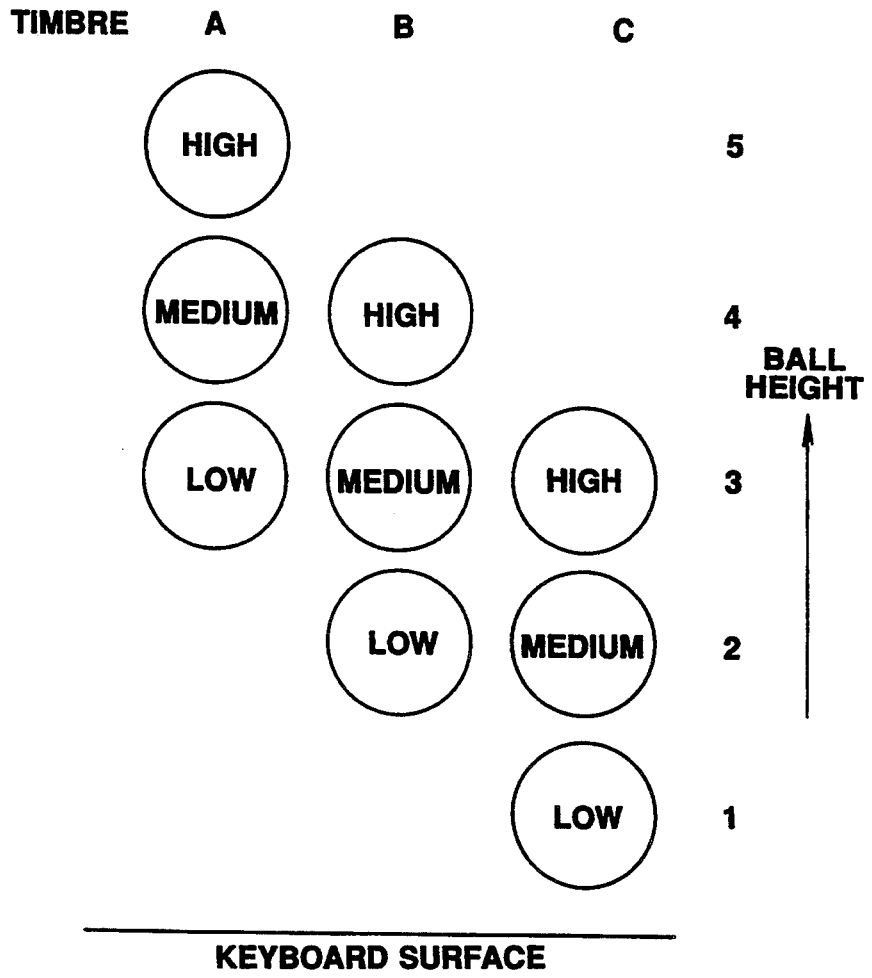
FIGS. 13A and B show the relationship between a combination of a set timbre and the pitch of a tone performed and the height of a ball in the eighth embodiment.

In the present embodiment, the height to which ball 102 is blown up changes, as shown in FIG. 13A, on the basis of a combination of the timbre data and pitch data input to CPU 304.

As will be obvious from FIG. 13B, when a key, for example, having a timbre "A" and a pitch "high", is depressed, the height to which ball 102 is blown up is "5", or maximum, while if a key, for example, having a timbre "C" and a pitch "low", is depressed, the height to which ball 102 is blown up is "1" or minimum.

In this case, in order to change the blown-up height of ball 102 in five levels, it is necessary to change the control voltage to DC voltage amplifier 606 of motor controller 501 of FIG. 6 in five levels.

To this end, in addition to input terminals A, B and C, input terminals D, E and resistors 604, 605 are added, and the resistance values of resistors 601–605 are set as follows:

resistor 601: 20 kΩ
resistor 602: 34 kΩ
resistor 603: 50 kΩ
resistor 604: 74 kΩ and
resistor 605: 100kΩ.

Figure 14:
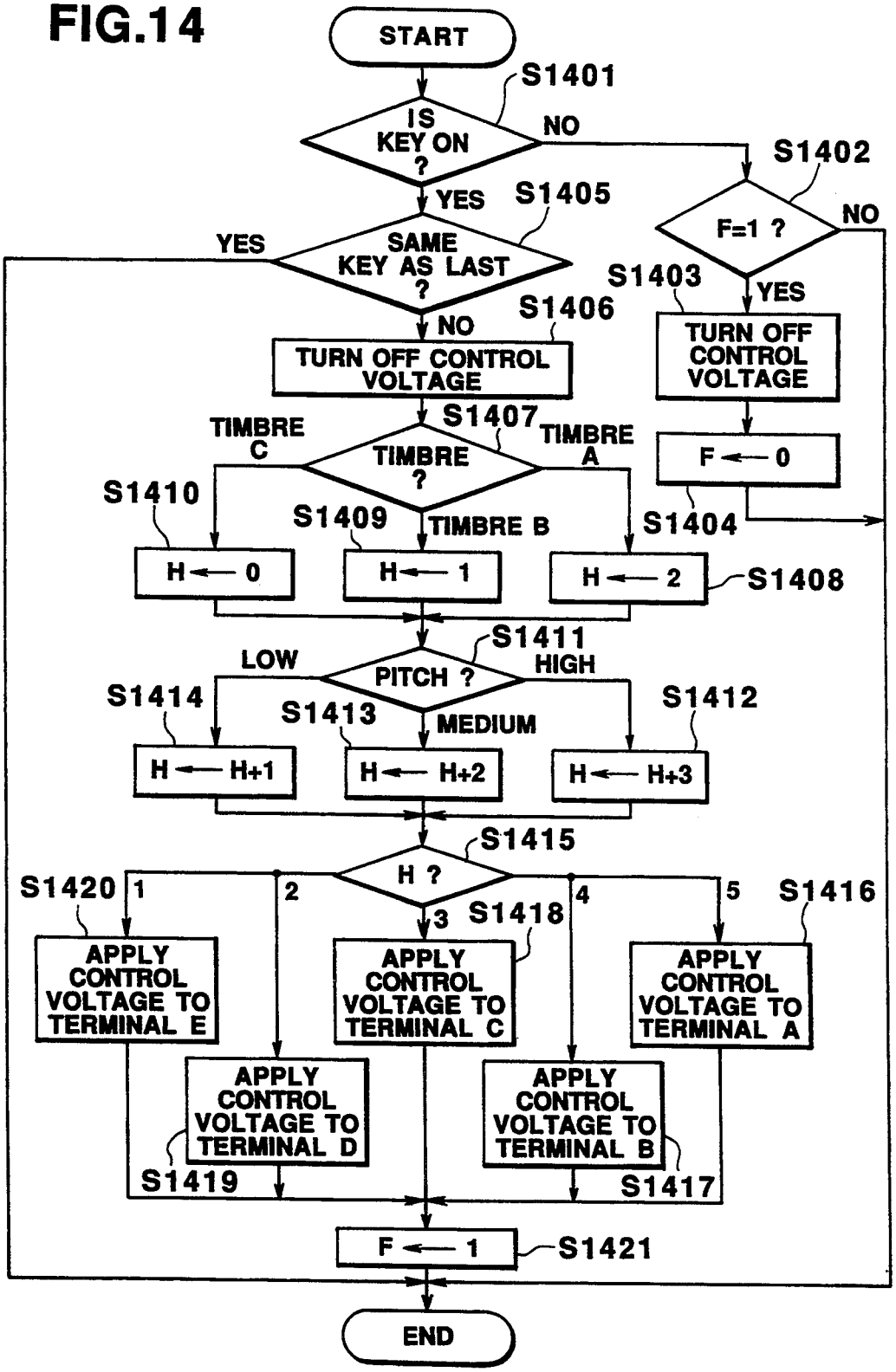
FIG. 14 is an operation flowchart for the eighth embodiment.

FIG. 14 is an operation flowchart for the eighth embodiment realized as the operation of CPU 304 of FIG. 5 which executes a control program stored in ROM 303.

First, CPU 304 determines whether a key on keyboard 302 is on (depressed) (step S1401).

If NO at step S1401, CPU 304 determines whether "1" (indicative of the depression of a key) is set in key depression flag F (step S1402).

If NO at step S1401, nothing is executed. If YES at step S1402, CPU 304 turns off its control voltage fed to motor controller 501 (step S1403) and then sets "0" in flag F (step S1404).

If at step S1401 CPU 304 determines that a key is depressed, CPU 304 determines at step S1405 whether the same key as that depressed last is depressed.

If so, nothing is executed. If not, CPU 304 temporarily turns off the control voltage output therefrom (step S1406).

As in the fourth embodiment, the selected timbre is determined (step S1407). If the selected timbre is "A", a value "2" is entered into a H register provided in CPU 304 (step S1408). If the selected timbre is "B", a value "1" is entered into H register (step S1409). If the selected timbre is "C", a value "0" is entered into H register (step S1410).

As in the second embodiment, the pitch for the depressed key is determined (step S1411). If the pitch (key number) for the depressed key is "high" (for example, C5, C6), a value "3" is added to H register. If the current timbre is "A", 2+3=5 is set in the H register (step S1412). If the pitch (key number) for the depressed key is "medium" (for example, C4–B5), a value "2" is added to H register. If the current timbre is, for example, "B", 1+2=3 is set in the H register (step S1413). If the pitch (key number) for the depressed key is "low" (for example, E2–B5), a value "1" is added to the H register. If the current timbre is, for example, "C", 0+1=1 is set in the H register (step S1414).

The final value in the H register on the basis of the timbre selected by the timbre select switch and the pitch of the depressed key are determined at step S1425. If the determined value is "5", the control voltage is applied to the input terminal A of motor controller 501 (step S1416). If the determined value is "4", the control voltage is applied to the input terminal B of motor controller 501 (step S1417). Thereafter, similarly, if the determined values are "3", "2" and "1", respectively, the control voltage is applied to the input terminals C, D and E, respectively, (steps S1418, S1419, S1420).

Thereafter, "1" is set in flag F to indicate key depression (step S1421).

As described above, by application of the control voltage to the input terminal selected by CPU 304 on the basis of a combination of the timbre selected by the timbre select switch and pitch data for the depressed key, the output voltage of motor controller 501 and the rotational speed of DC motor 312 are changed. Therefore, the pressure of air blast from blower 313 (duct 201) changes in five levels and the height to which the ball 2 is blown up is changed accordingly.

Outline of Ninth and Tenth Embodiment

A ninth and a tenth embodiment will be outlined next.

In the first embodiment, the height to which ball 102 (see FIG. 1) is blown up changes depending on the form of performance such as manual performance or automatic performance or timbre.

Figure 15A:
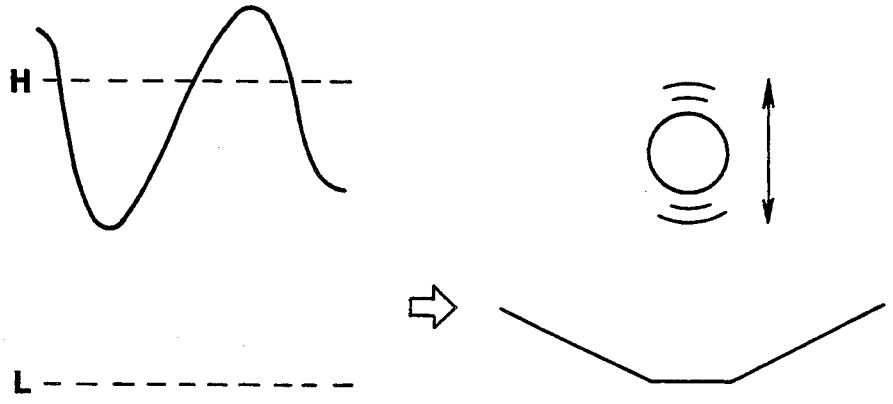
FIGS. 15A–C illustrates the principles of operation of a ninth and a tenth embodiment, respectively.
Figure 15B:
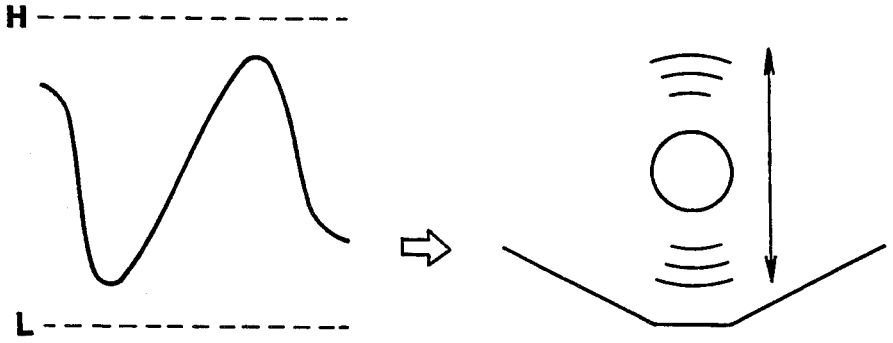

If, for example, a voltage corresponding to the amplitude envelopes of a tone signal input to the motor to blow ball 102 up changes in a range with an upper limit value H and a lower limit value L as shown in the left-hand portion of FIG. 15B, ball 102 moves up and down within an appropriate range, as shown in the right-hand portion of FIG. 15B.

In contrast, if the voltage changes in the vicinity of upper limit value H as shown in the left-hand portion of FIG. 15A, ball 102 is blown up and maintained high, as shown in the right-hand portion of FIG. 15A.

Figure 15C:
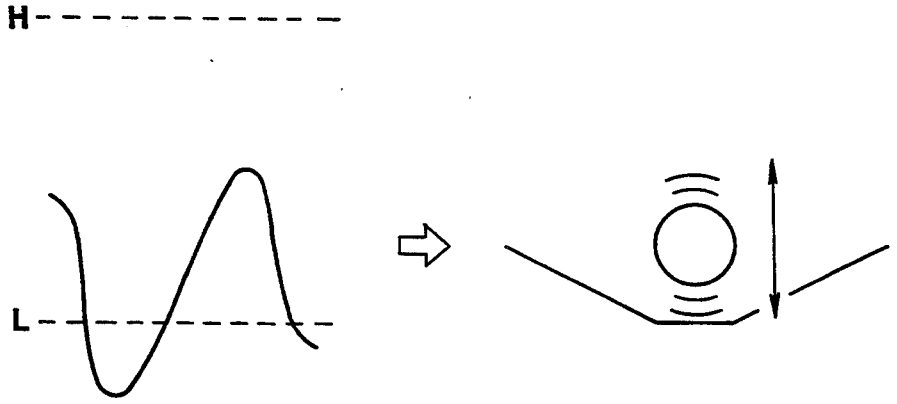

If the voltage changes in the vicinity of the lower limit value L, as shown in the left-hand portion of FIG. 15C, ball 102 is maintained substantially not blown up, as shown in the right-hand portion of FIG. 15C.

In the ninth embodiment, an offset voltage applied to the motor is automatically adjusted on the basis of the form of the performance and/or timbre to thereby maintain the ball in the state such as is shown in FIG. 15B. In the tenth embodiment, the rotational speed of the motor is detected and an offset voltage applied to the motor is automatically adjusted on the basis of the result of the detection to thereby maintain the ball in the state such as is shown in FIG. 15B.

The ninth and tenth embodiments are sequentially described in detail below.

Ninth Embodiment

In the present embodiment, the height to which ball 102 is blown up changes on the basis of the volume of a tone played as in the first embodiment.

Figure 16:
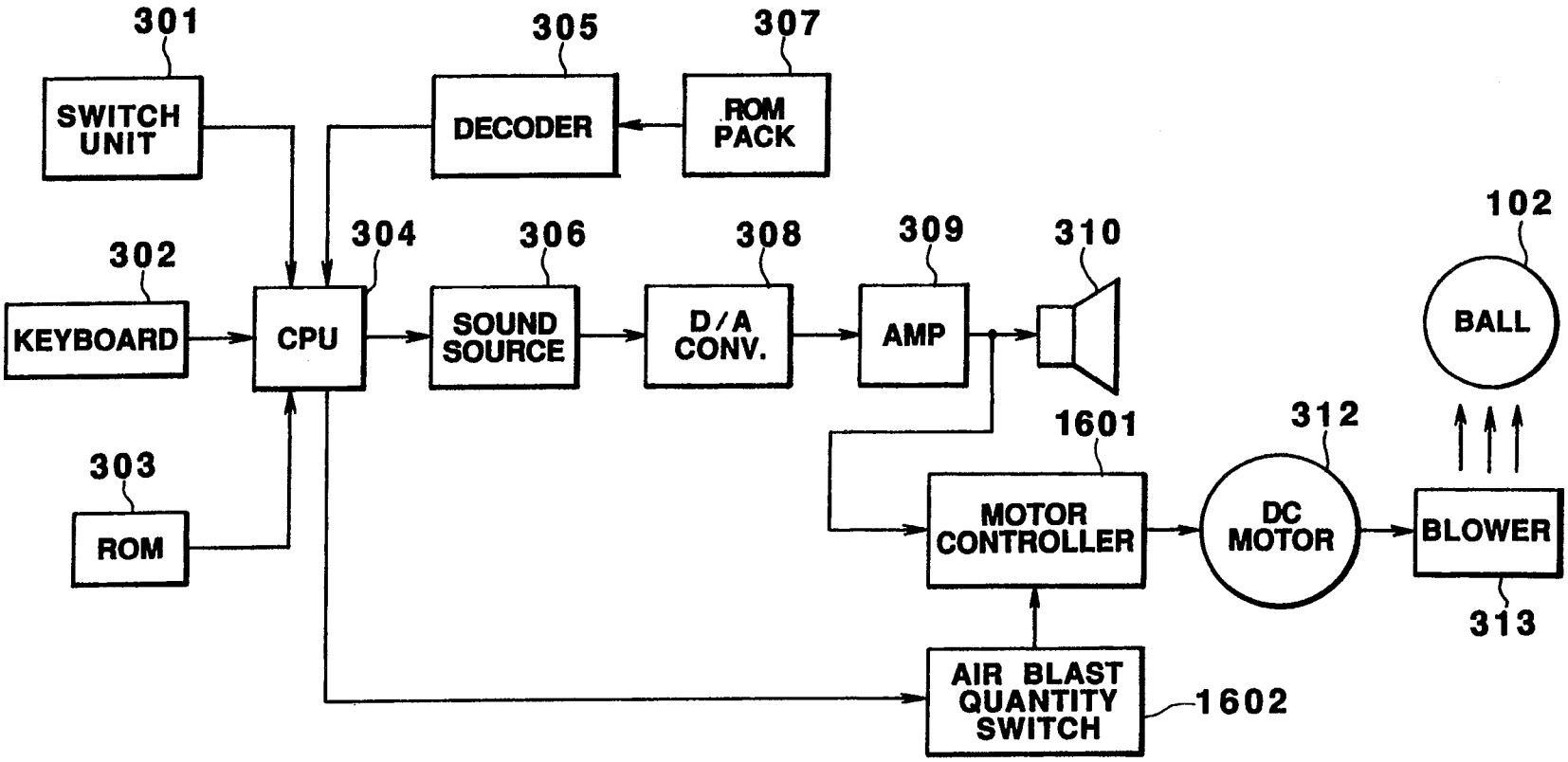
FIG. 16 shows the overall structure of the ninth embodiment.

FIG. 16 is a block diagram indicative of the overall structure of the embodiment. The same number in FIGS. 16 and 3 denote elements having the same function.

In FIG. 16, CPU 304 delivers to air blast quantity switching unit 1602 a control signal corresponding to the kind of the current form of performance (for example automatic performance, manual performance) set by a performance form setting switch (not shown) in switch unit 301. Air blast quantity switching unit 1602 selects its output delivered to motor controller 1601 in accordance with the control signal. Motor controller 1601 controls an offset voltage for a DC voltage which drives DC motor 312 in accordance with the output voltage from air blast quantity switching unit 1602.

Figure 17:
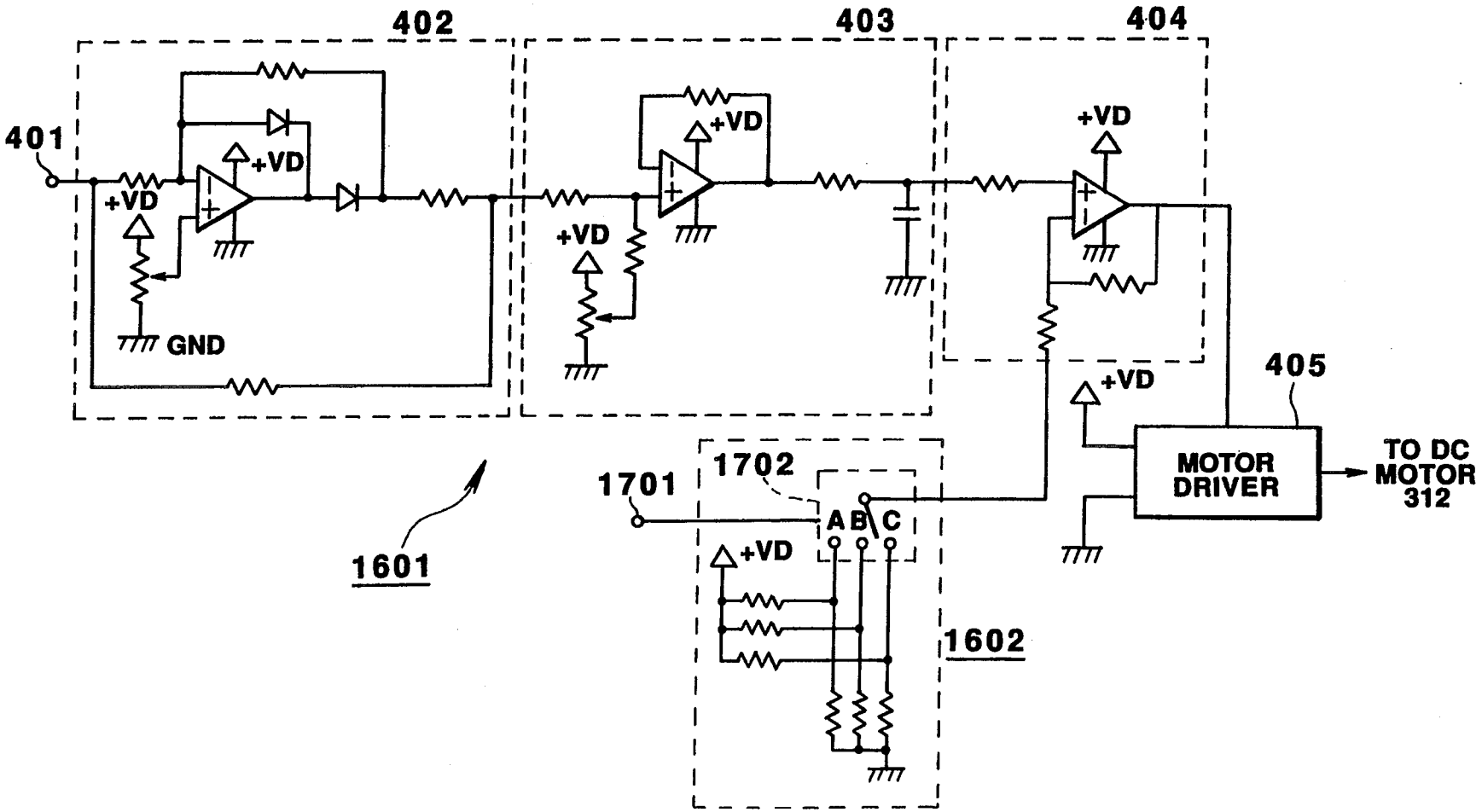
FIG. 17 is a circuit diagram of a motor controller and an air blast quantity switching unit of the ninth embodiment.

FIG. 17 is a circuit diagram of motor controller 1601 and air blast quantity switching unit 1602 of FIG. 16, and the same number the same function. Motor controller 1601 is composed of full-wave rectifier 402, LPF 402, DC amplifier 404 and motor driver 405.

In FIG. 17, the output voltage not from electronic variable resistor 406 (see FIG. 4) but from air blast quantity switching unit 1602 is applied to a negative voltage terminal of DC amplifier 404.

In air blast quantity switching unit 1602, voltage values obtained by dividing a voltage +VD by different values are obtained at terminals A, B and C of select switch 1702.

CPU 304 of FIG. 16 delivers a control signal which selects one of terminals A, B and C of select switch 1702 to input terminal 1701 of air blast quantity switching unit 1602 depending on the current selected one of manual performance, automatic performance and automatic accompaniment at switch unit 301.

As a result, an offset voltage corresponding to the current form of performance selected in switch unit 301 is applied to the negative voltage terminal of DC amplifier 404 from air blast switching unit 1602. DC amplifier 404 amplifies a DC voltage corresponding to the amplitude envelope or volume of a tone signal received from LPF 403, using the offset voltage as a base, and delivers the resulting DC voltage to motor driver 405 to thereby drive DC motor 312 (FIG. 16).

By the above operation, the DC voltage fed to motor driver 405 is corrected so as to change between upper and lower limit values H and L, as shown in the left-hand portion of FIG. 15B, in accordance with the current form of performance, and ball 102 moves up and down the appropriate range as shown in the right-hand portion of FIG. 15B.

Tenth Embodiment

In the present embodiment, the height to which ball 102 is blown up changes on the basis of the volume of a tone played as in the first embodiment.

Figure 18:
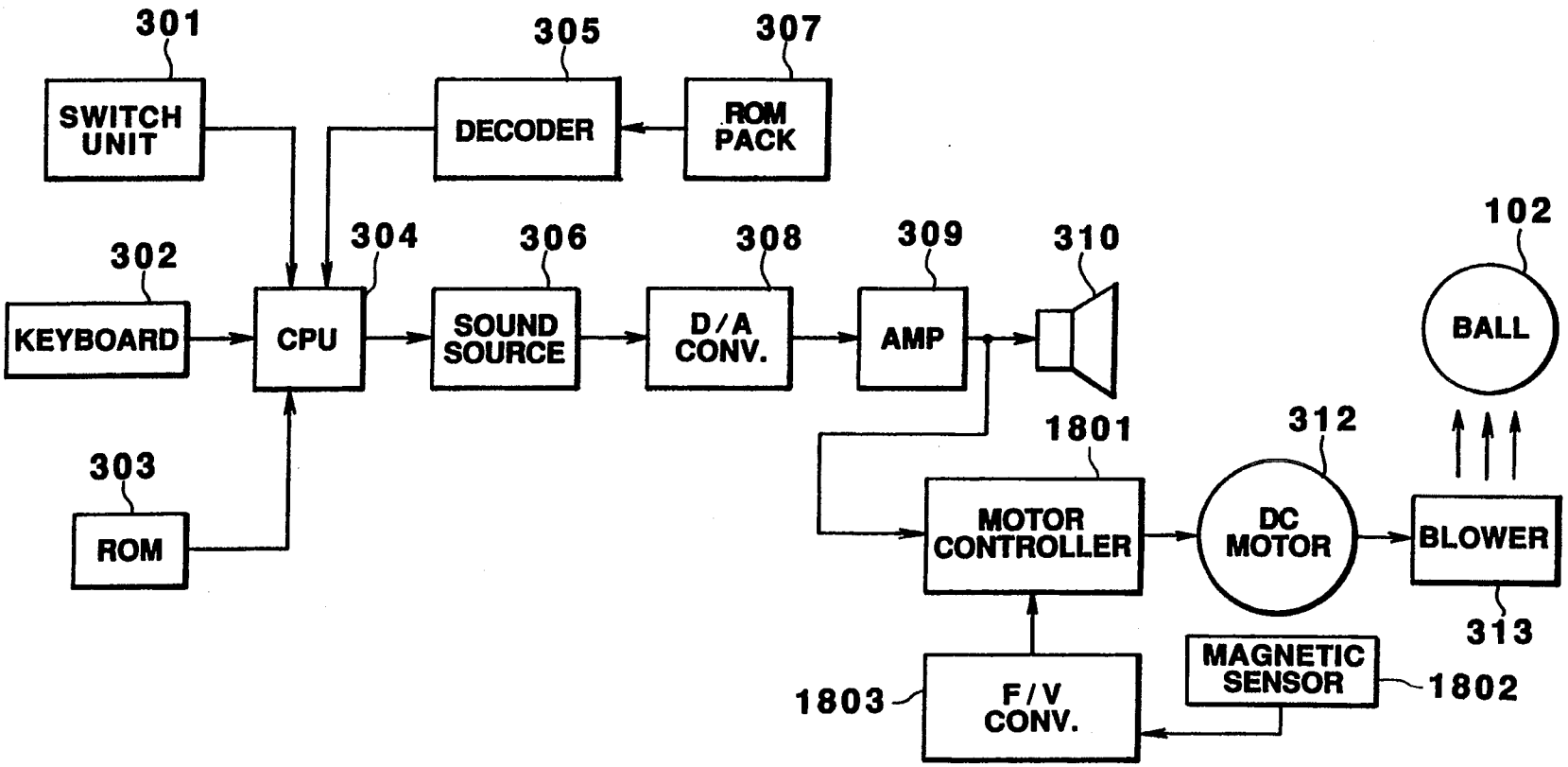
FIG. 18 shows the overall structure of the tenth embodiment.

FIG. 18 is a block diagram indicative of the overall structure of the embodiment. The same number in FIGS. 18 and 3 denote elements having the same function.

In FIG. 18, magnetic sensor 1802 delivers to frequency-to-voltage convertor (F/V convertor) 1803 a control signal having a frequency corresponding to the current rotational period of DC motor 312. F/V convertor 1803 switches its output voltage to motor controller 1801 in accordance with the control signal. Motor controller 1801 controls an offset voltage for a DC voltage which drives DC motor 312 in accordance with the output voltage from F/V convertor 1803.

Figure 19:
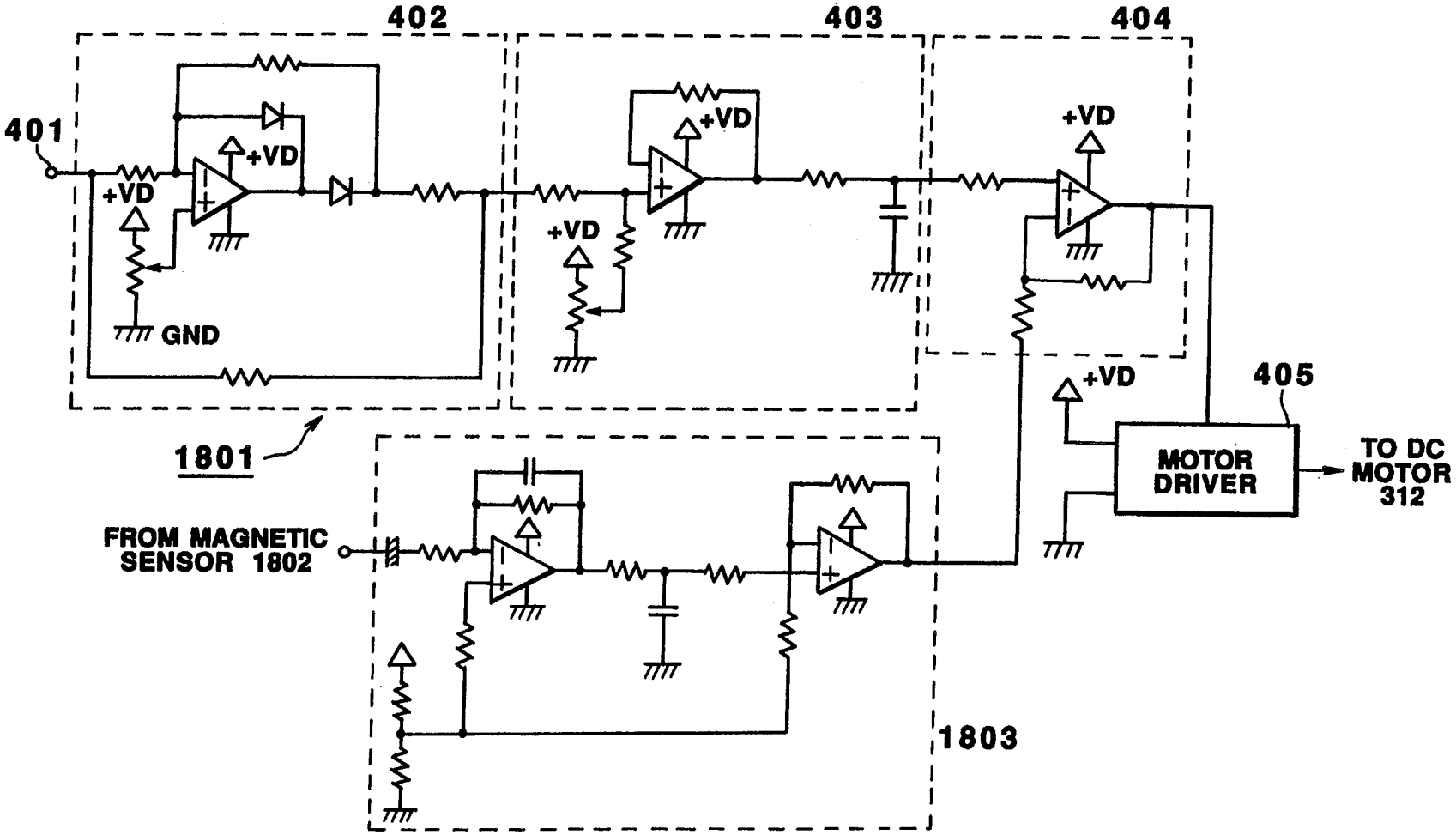
FIG. 19 is a circuit diagram of a motor controller and an F/V Converter of the tenth embodiment.

FIG. 19 is a circuit diagram of motor controller 1801 and F/V convertor 1803, and the same number in FIGS. 19 and 4 denote elements having the same function. Motor controller 1801 is composed of full wave rectifier 402, LPF 402, DC amplifier 404 and motor driver 405.

In FIG. 19, the output voltage not from electronic variable resistor 406 (see FIG. 4) but from F/V convertor 1803 is applied to a negative voltage terminal of DC amplifier 404.

First, in FIG. 18, magnetic sensor 1802 outputs a pulse signal corresponding to the rotational speed of DC motor 312. The pulse width of the pulse signal increases as the rotational speed of DC motor 312 decreases while the pulse width deceases as the rotational speed of the DC motor increases.

In FIG. 19, F/V converter 1803 amplifies the pulse signal received from magnetic sensor 1802, integrates the pulse signal with a CR filter, amplifies the integrated voltage and delivers it as an offset voltage to the negative voltage terminal of DC amplifier 404.

At this time, the CR time constant of the CR filter is set such that ball 102 (see FIG. 18) floats at a middle position in a range of vertical movement.

When the average value of the DC voltage corresponding to the amplitude envelope of the tone signal output from LPF 403 or the volume of the tone, and the average rotational speed of DC motor 312 are small, the pulse width of a pulse signal from magnetic sensor 1802 is larger than a period corresponding to a cutoff frequency determined by the CR time constant set in the CR filter of F/V converter 1803. As a result, the output voltage from F/V converter 1803 and the offset voltage in DC amplifier 404 are reduced to increase the output voltage from DC amplifier 404.

When the average value of the DC voltage corresponding to the amplitude envelope of the tone signal output from LPF 403 or the volume of the tone, and hence the rotational speed of DC motor 312 are larger, the pulse width of a pulse signal from magnetic sensor 1802 is smaller than a period corresponding to a cutoff frequency determined by the CR time constant set in the CR filter of F/V converter 1803. As a result, the output voltage from F/V converter 1803 and the offset voltage in DC amplifier 404 are increased to reduce the output voltage from DC amplifier 404.

By the above operation, the DC voltage fed to motor driver 405 is automatically corrected so as to change within a range having upper limit value H and lower limit value L, as shown in the left-hand portion of FIG. 15B, and hence ball 102 is moved up and down within an optimal range as shown in the right-hand portion of FIG. 15B, even if the volume of the tone is changes depending on the timbre of the tone and/or the form of performance.

Eleventh Embodiment

In the present embodiment unlike the first embodiment, when the volume of a tone performed is larger, the height to which ball 102 is blown up is lower while when the volume is smaller, the height to which the ball 102 is blown up is higher.

The appearance of the present embodiment is similar to that of FIG. 1A. A view of the overall structure of this embodiment is the same as FIG. 3 except for the circuit of motor controller 311 shown in FIG. 20. The structure of FIG. 20 is substantially the same as that of the circuit diagram of the motor controller of the FIG. 4 first embodiment, and the same reference number in FIGS. 20 and 4 denotes elements having the same function.

Figure 20:
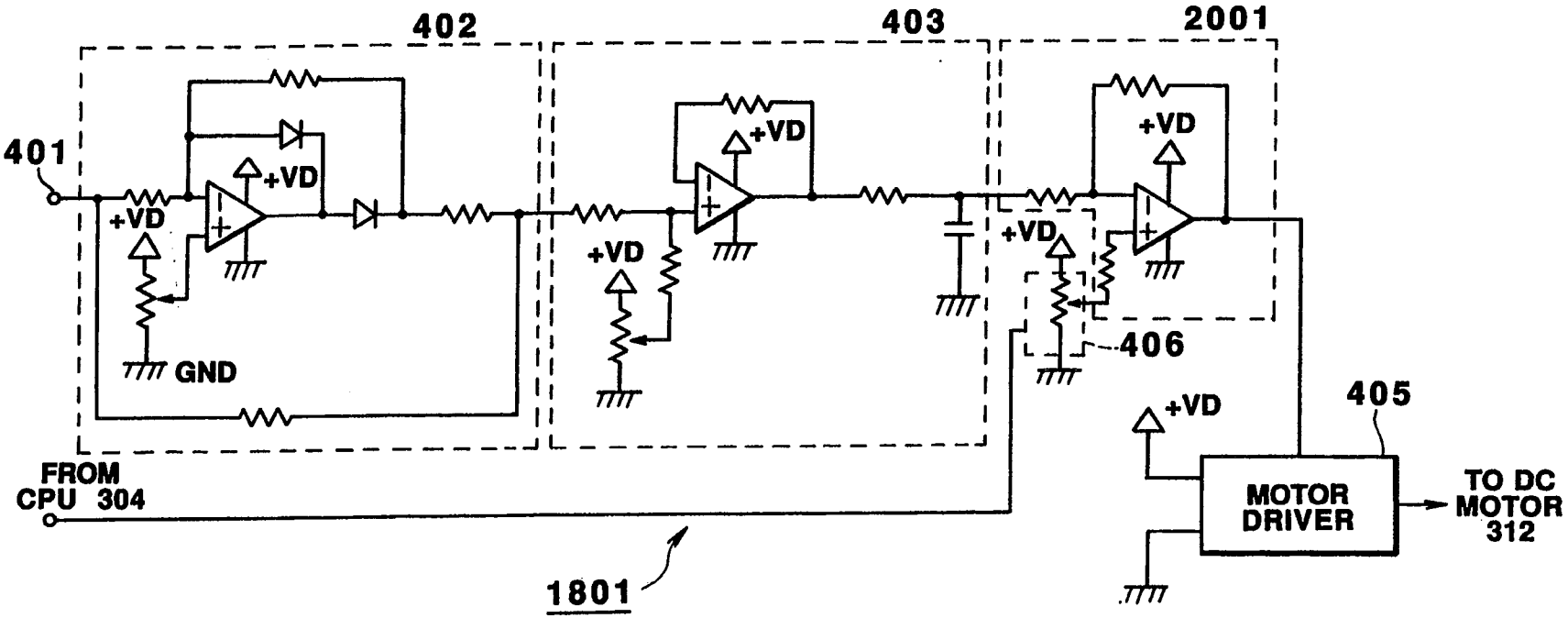
FIG. 20 is a circuit diagram of a motor controller of an eleventh embodiment.

In FIG. 20, an inverting amplifier 2001 is connected to the output of LPF 403. Since the (+) input side voltage level of inverting amplifier 2001 is higher than its (−) input side voltage level, the output voltage from amplifier 2001 increases as a DC voltage corresponding to the amplitude envelope of a tone signal input from input terminal 401 to full-wave rectifier 402 decreases. This DC voltage is power amplified by motor driver 405 comprising a power amplifier, the output voltage from which is fed to DC motor 312.

In this case, in order to adjust the height to which ball 102 is blown up, it is required to adjust the pressure of air blast from blower 313 (duct 201) of FIG. 3. To this end, when the user adjusts a particular knob on switch unit 301 of FIG. 3, CPU 304 delivers a control voltage corresponding to a quantity of manipulation of the knob to electronic variable resister 406 connected to inverting amplifier 2001 to thereby control an offset voltage in amplifier 2001.

By the above structure, the output voltage level from amplifier 2001 increases as the DC voltage corresponding to the amplitude envelope of the tone signal from tone source 306 or the volume of the tone decreases on the basis of performance data from keyboard 302 or ROM pack 307 of FIG. 3.

Figure 21A:
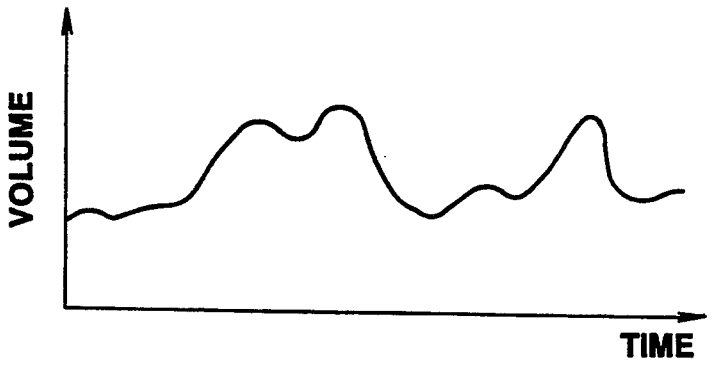
FIGS. 21A–C shows changes in the height to which the ball is blown up and changes in the volume with time in the eleventh embodiment.
Figure 21B:
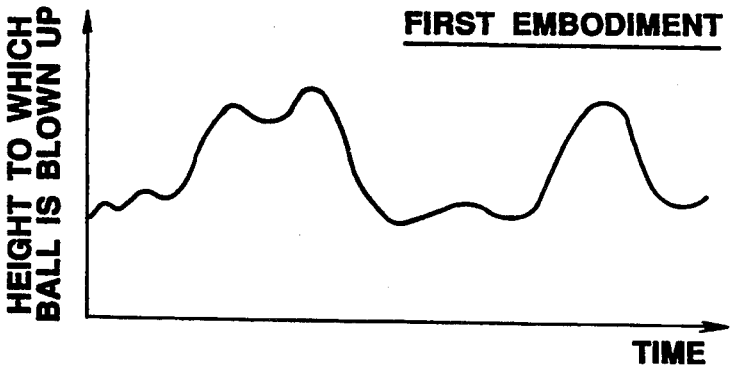
Figure 21C:
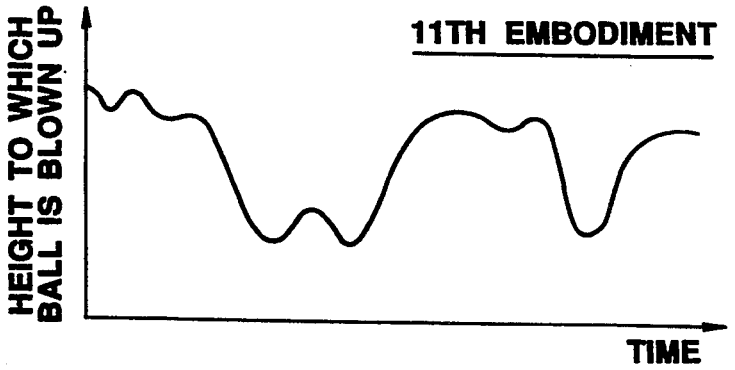

As a result, when the rotational speed of DC motor 312 changes and the volume of the tone changes as shown in FIG. 21A, ball 102 is blown up, as shown in FIG. 21C. More particularly, when the volume of the tone is smaller, the ball is higher blown up while when the volume is larger, the ball is lower blown up. FIG. 21B shows the case of the first embodiment for comparing purposes. In this case, ball 102 is higher blown up when the volume is larger while the ball is lower blown up when the volume is smaller.

Twelfth Embodiment

Figure 22:
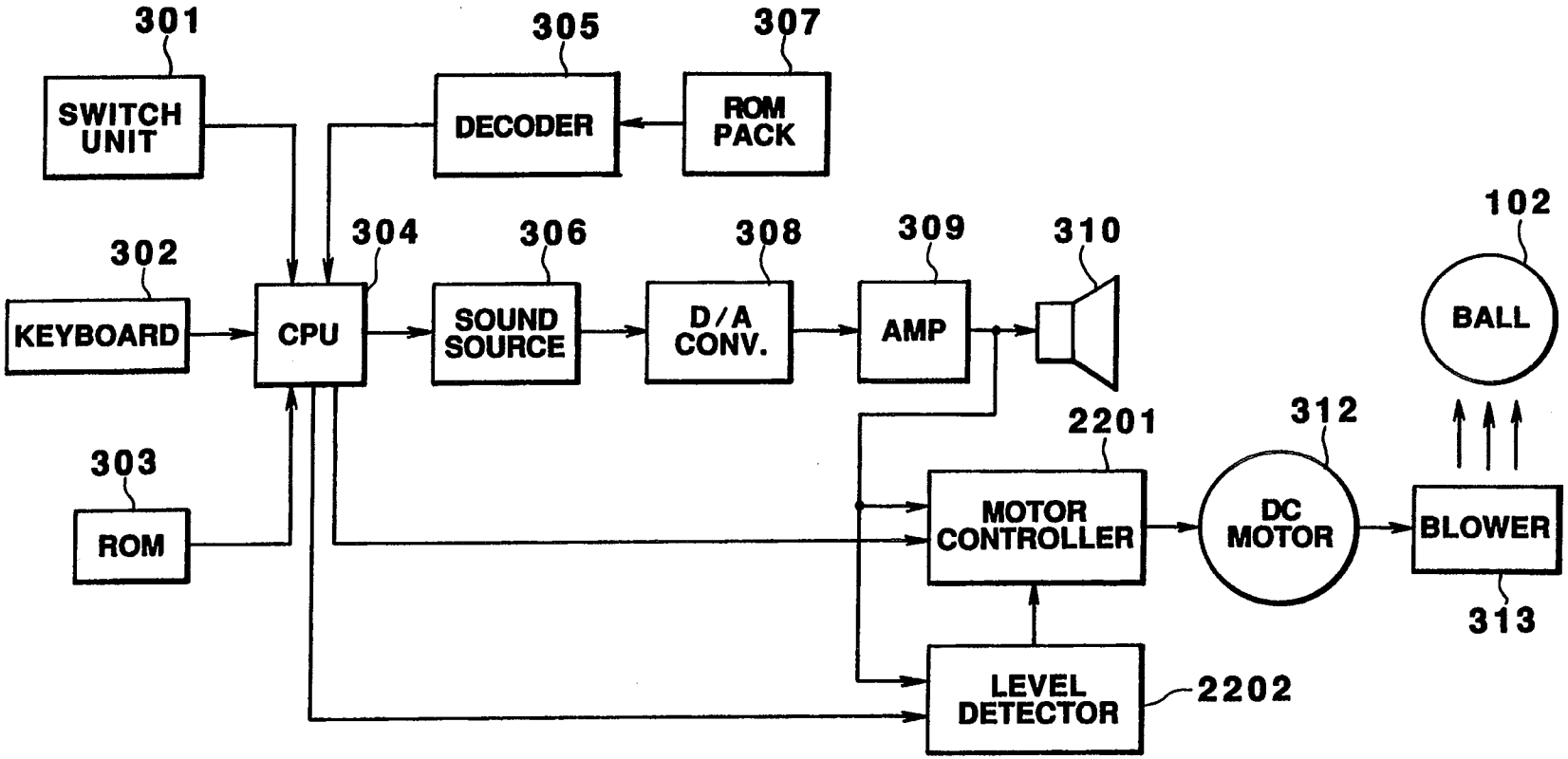
FIG. 22 shows the overall structure of a twelfth embodiment.

The appearance of the present embodiment is similar to that of the embodiment of FIG. 1A and the overall structure of the embodiment is shown in FIG. 22.

The structure of the embodiment of FIG. 22 is substantially similar to the structure of the first embodiment of FIG. 3 and the same reference number in FIGS. 22 and 3 denote elements having the same function.

FIG. 22 is different from FIG. 3 in that level detector 2202, newly provided, detects the envelope of a tone signal or the volume of the tone. When the volume of the tone is lower than a predetermined level value, DC motor 312 is reversely rotated by motor controller 2201 on the basis of a "low" level detection signal from level detector 2202, so that ball 102 is drawn to blower hole 103 while when the volume of the tone is higher than the predetermined value, DC motor 312 is rotated forwardly on the basis of a "high" level detection signal from level detector 2202, so that ball 102 is blown up.

The predetermined level value is set by a control signal from CPU 304 to level detector 2202, the signal being produced by user's operation of a switch in stitch unit 301.

Figure 23:
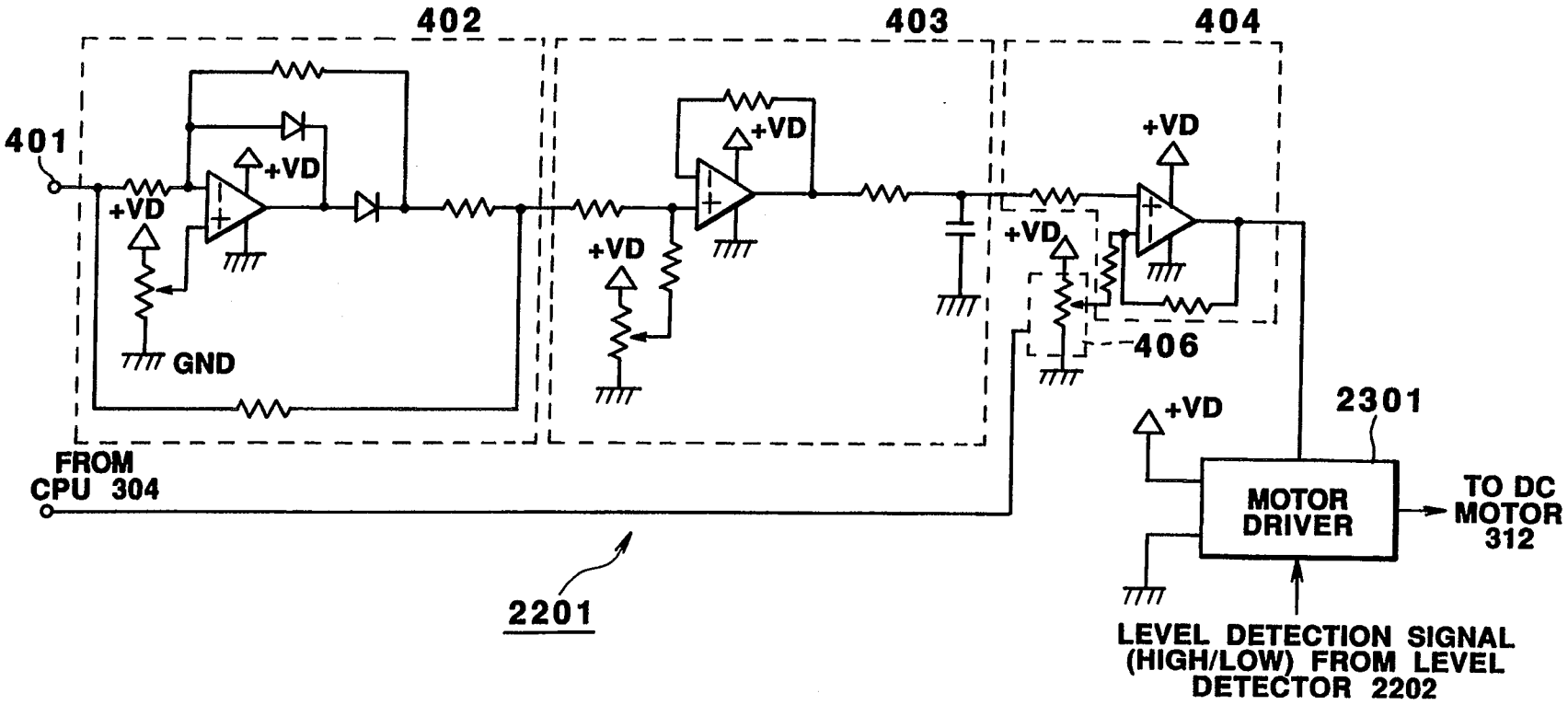
FIG. 23 is a circuit diagram of a motor controller of the twelfth embodiment.

FIG. 23 shows the circuit of motor controller 220 of the twelfth embodiment. The circuit diagram of FIG. 23 is substantially similar to that of the FIG. 4 first embodiment and the same number FIGS. 23 and 4 denotes elements having the same function.

In FIG. 23, motor driver 2301 is not simply a power amplifier (in the case of the first embodiment) for rotating DC motor 312, but power amplifies the output voltage from DC amplifier 404 and applies the amplified power to DC motor 312 such that when the level detection signal from level detector 2202 of FIG. 22 is "high", DC motor 312 rotates forwardly while when the level detection signal is "low", DC motor 312 rotates reversely.

By the above structure, ball 102 is drawn down when the amplitude envelope of the tone signal from sound source 306 or the volume of the tone is lower than a predetermined level while the ball is blown up when the volume of the tone is higher than the predetermined level, on the basis of the performance data from keyboard 302 or ROM pack 307 of FIG. 22.

Figure 24A:
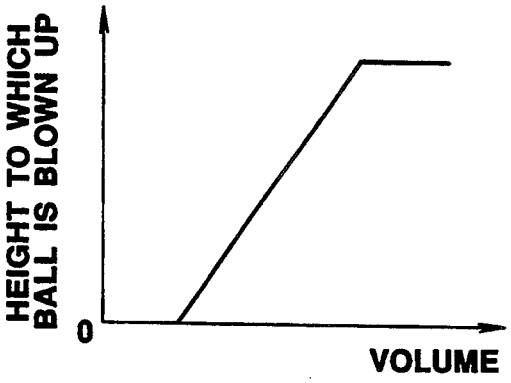
FIGS. 24A and B shows the relationship between volume and height to which the ball is blown up in the twelfth embodiment.
Figure 24B:
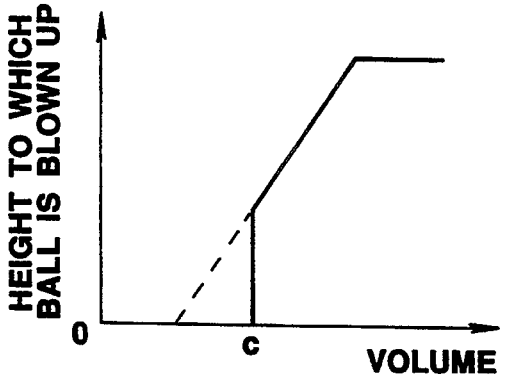

FIGS. 24A and B show the relationship between volume of the tone and height to which ball 102 is blown up. FIG. 24B shows that when the volume of the tone is lower than a predetermined level c, ball 102 is not blown up while when the volume exceeds the level c, the ball is rapidly blown up. The broken line in FIG. 24B, and FIG. 24A show the case of the first embodiment.

Figure 25A:
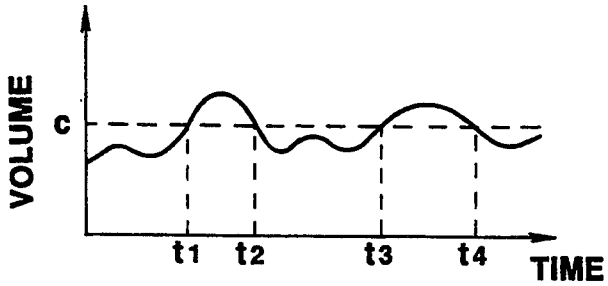
FIGS. 25A–C shows the relationship between changes in the volume with time and height to which the ball is blown up in the twelfth embodiment.
Figure 25B:
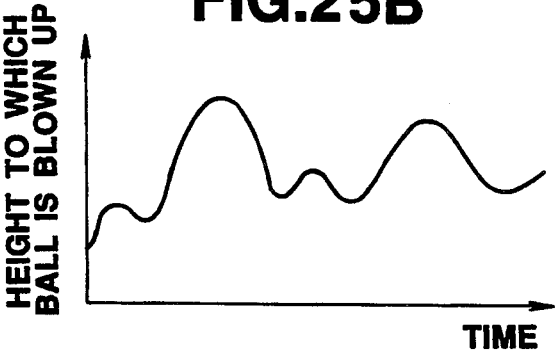
Figure 25C:
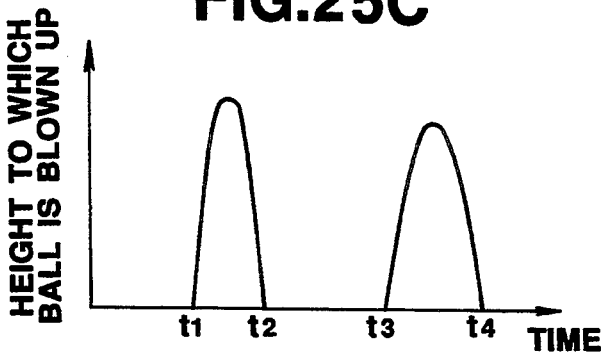

FIGS. 25A–C show changes in the height to which ball 102 is blown up depending on changes in the volume with time.

In the case of the first embodiment of FIG. 25B, changes in the height to which the ball is blown up are equal to changes in the volume of the tone shown in FIG. 25A while in the case of the present embodiment of FIG. 25B the ball is rapidly blown up only when the volume is higher than the predetermined value c. Therefore, in the present embodiment, the move of the ball is greatly large and dynamic compared to the first embodiment.

Thirteenth Embodiment

Figure 26:
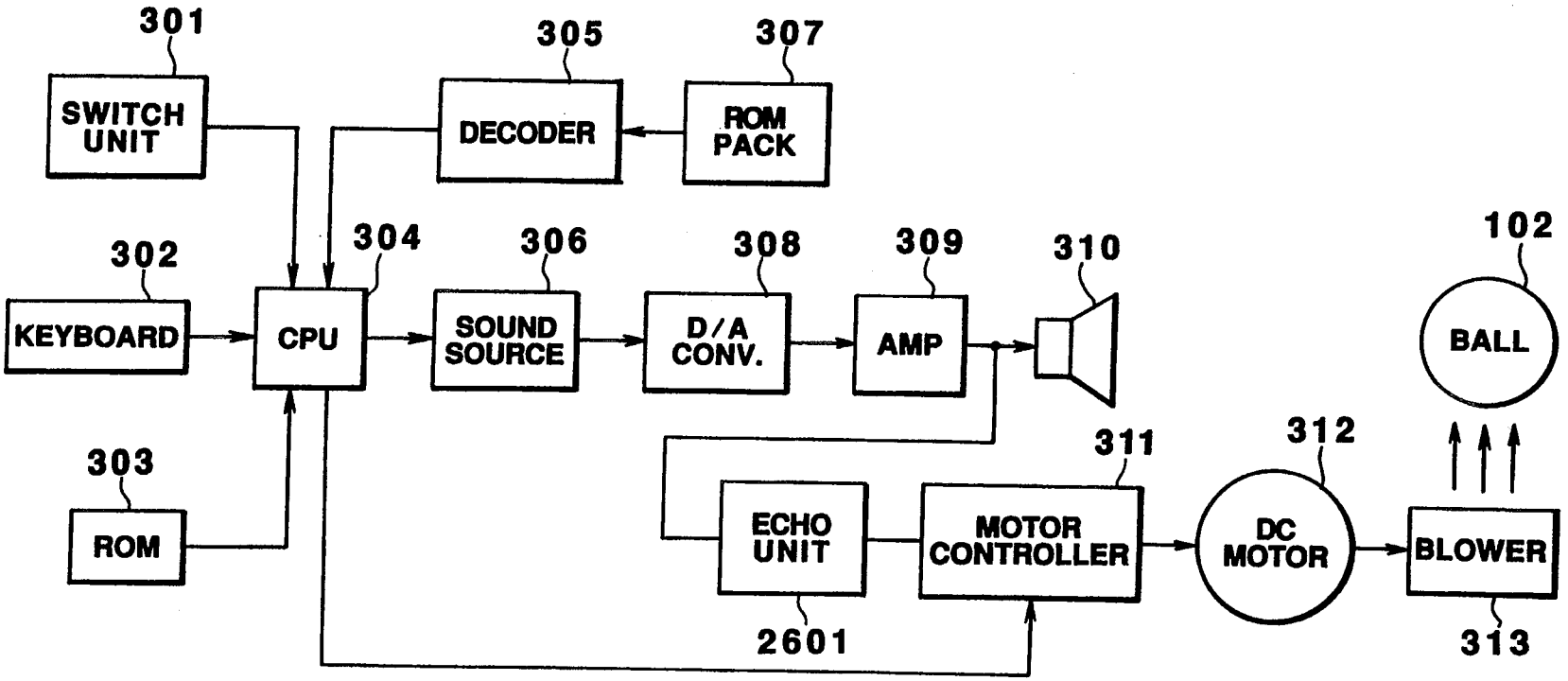
FIG. 26 shows the overall structure of a thirteenth embodiment.

The present embodiment is similar in appearance to the embodiment of FIG. 1 and the overall structure of the present embodiment is shown in FIG. 26.

The structure of FIG. 26 is substantially the same as that of the FIG. 3 first embodiment and the same reference numeral in FIGS. 26 and 3 denote elements having the same function.

The embodiment of FIG. 26 is different from that of FIG. 3 in that motor controller 311 does not control the rotational speed of DC motor 312 in direct accordance with the amplitude envelope of the tone signal output from amplifier 309 or the volume of the tone (which is the case with the first embodiment), but echo unit 2601 adds an echo effect to the output from amplifier 309 to change the volume of the tone or the amplitude envelope of the tone signal to thereby control the rotational speed of DC motor 312.

By the above structure, the volume of the tone changes in a complicated manner as the result of the addition of an echo effect to the amplitude envelope of the tone signal from sound source 306 on the basis of the performance data from keyboard 302 or ROM pack 307 of FIG. 26.

Figure 27A:
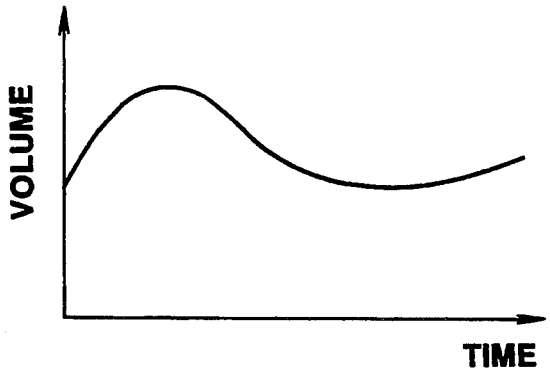
FIGS. 27A–C shows the relationship between changes in the volume with time and height to which the ball is blown up in the thirteenth embodiment.
Figure 27B:
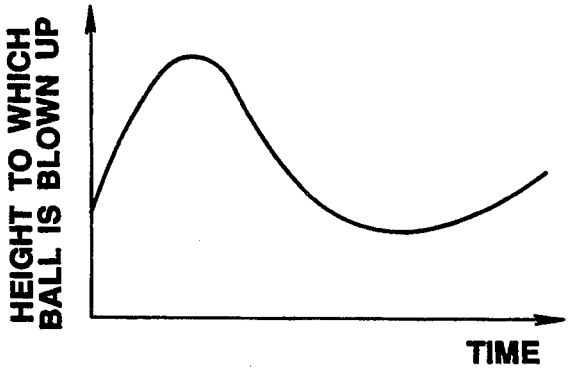
Figure 27C:
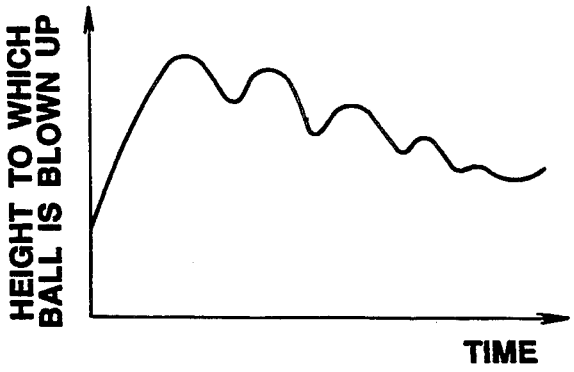

Therefore, when the rotational speed of DC motor 312 changes and the volume of the tone changes as shown in FIG. 27A, the height to which the ball 102 is blown up changes in a complicated manner as shown in FIG. 27C compared to the first embodiment of FIG. 27B.

Fourteenth Embodiment

Figure 28:
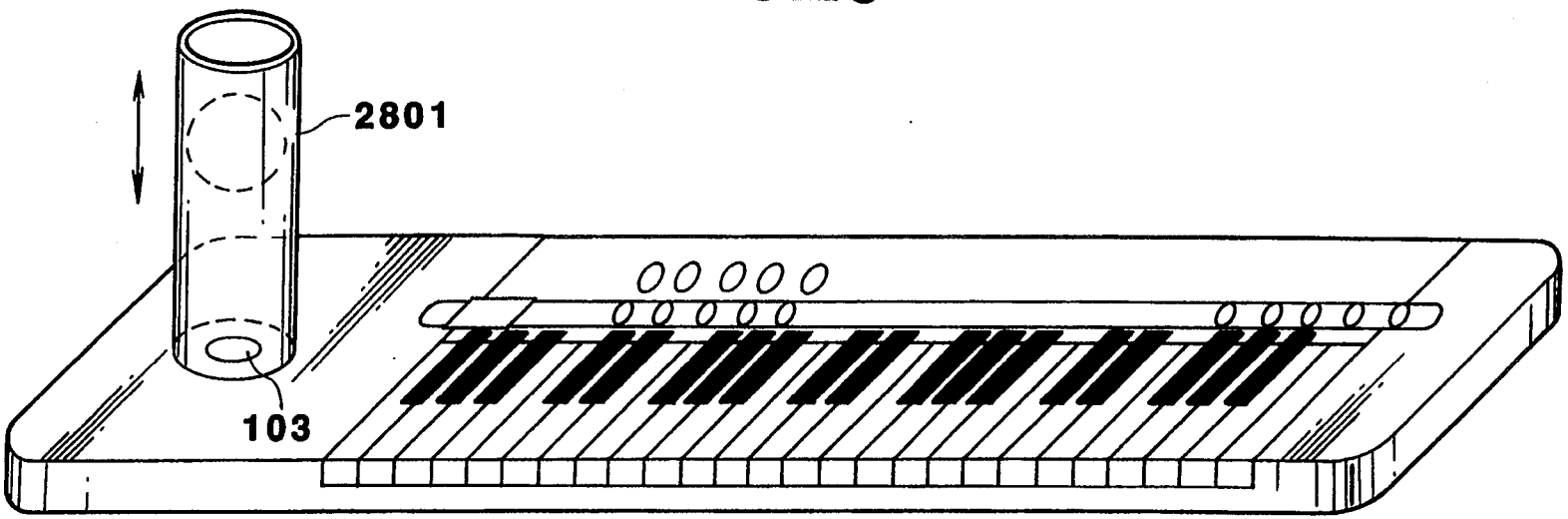
FIG. 28 shows the appearance of a fourteenth embodiment.

FIG. 28 shows the appearance of the present embodiment. This embodiment is different from the FIG. 1 first embodiment in that ball 102 is blown up by air blast from blower hole 103 provided in a transparent cylindrical case 2801.

The overall structure of the present embodiment may be any one of the first–thirteenth embodiments and the operation of the present embodiment is as described above.

Fifteenth Embodiment

The present embodiment relates to an adapter composed of functional elements, which blow the ball up, such as the blower and DC motor, separated from an electronic musical instrument.

Figure 29:
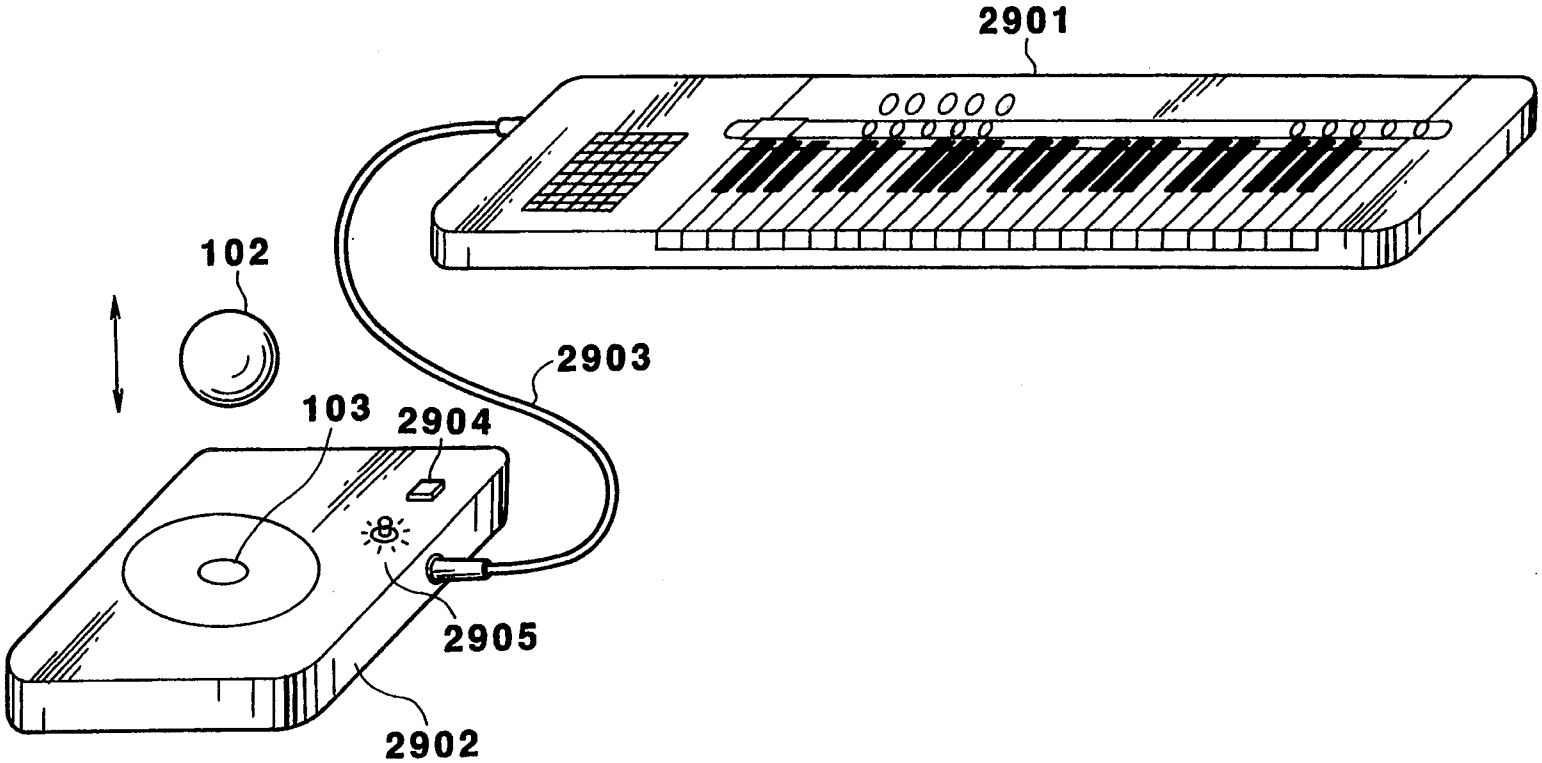
FIG. 29 shows the appearance of a fifteenth embodiment.

FIG. 29 shows the appearance of the present embodiment. In FIG. 29, adapter 2902 is connected through a connection code 2903 to electronic musical instrument 2901. Adapter 2902 is provided with a power source switch 2904, and an adjustment knob 2905 used to adjust the height to which ball 102 is blown up by the air from blower hole 103.

Figure 30:
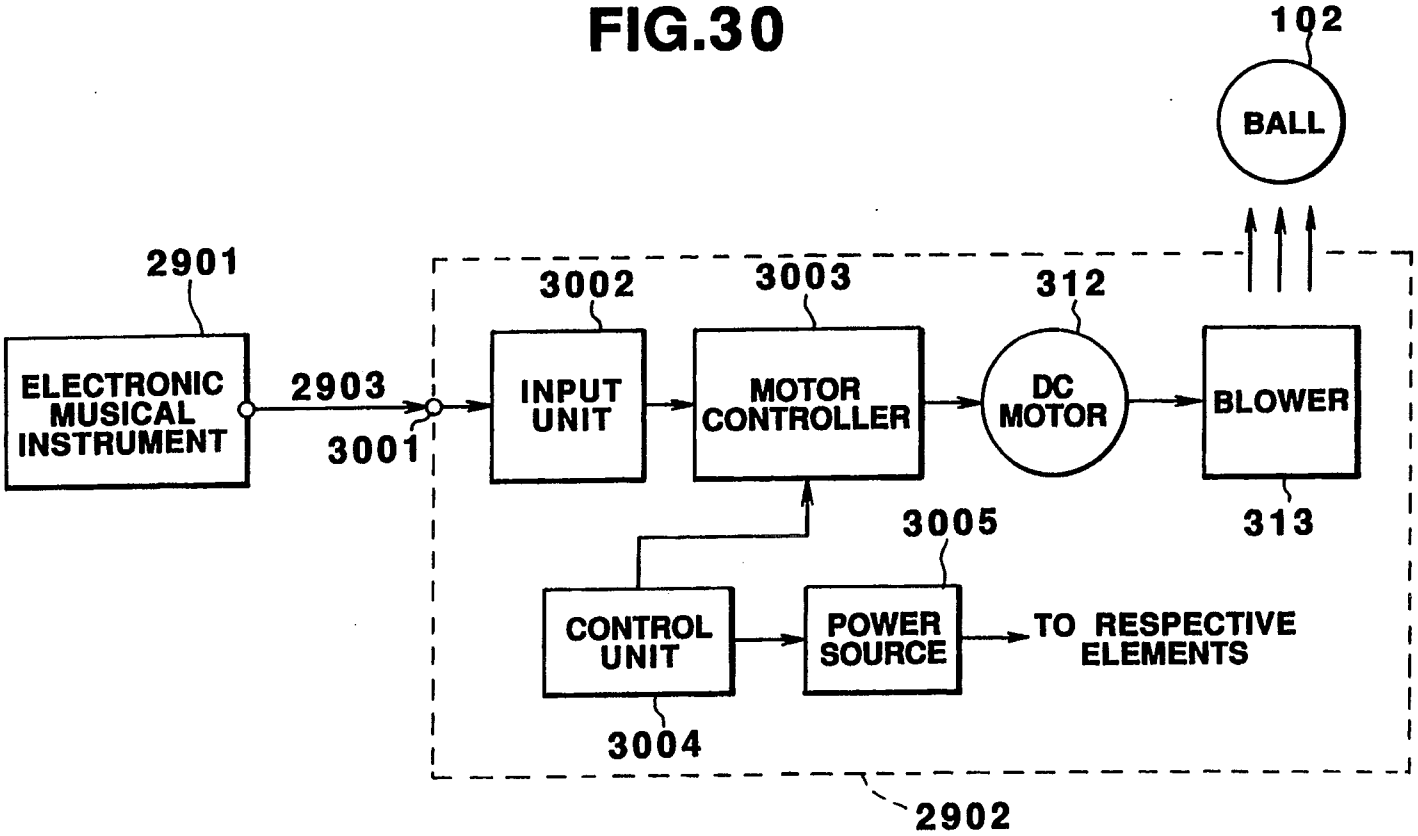
FIG. 30 shows the overall structure of the fifteenth embodiment.

FIG. 30 is a block diagram indicative of the overall structure of the present embodiment. In FIG. 30, the output from electronic musical instrument 2901 is input from a group of input terminals 3001, to be described later in more detail, through connection cord 2903 to input circuit 3002 of adapter 2902.

Input circuit 3002 is provided with a D/A converter (not shown) or MIDI (Musical Instrument Digital Interface) signal converter to be described in more detail later. When the output from musical instrument 2901 is a digital tone waveform signal, this signal is input from a digital signal input terminal of input terminals 3001, and converted by the D/A converter to analog signal, which is then input to motor controller 3003, which may take the same structure as any one of the circuits of FIGS. 4, 6, 17, 19, 20 and 23 in accordance with the form of a signal input to input circuit 3002 to control the height to which ball 102 is blown up.

Power source 3005 feeds power to the respective elements of the circuit concerned. Power source switch 2904 in operation unit 3004 switches on/off power source 3005.

When the output from musical instrument 2901 is an analog tone waveform signal, the signal is input from an analog signal input terminal of input terminals 3001 through adapter 2902 to motor controller 3003.

When the signal input to input terminals 3001 is tone control signal which is a MIDI signal from musical instrument 2901, performance data such as pitch, velocity, timbre or pitch bend data contained in the MIDI signal is taken by the MIDI signal converter and delivered to motor controller 3003.

Thereafter, the rotational speed of DC motor 312 is controlled by motor controller 3003 on the basis of the amplitude envelope of the input signal received through input terminals 3001, or various data of the MIDI signal, and a combination of some or all of them and the height to which ball 102 is blown up is changed by the pressure of air blast from blower 313.

When the user manipulates adjustment knob 2905 (FIG. 29) in operation unit 3004 for adjustment of the height to which ball 102 is blown up, CPU 304 of motor controller 3003 controls the offset voltage and the adjustment of the height to which the ball is blown up as described with reference to the first embodiment. The operation of ball 102 being blown up is as described above.

Sixteenth Embodiment

<Structure>

Figure 31:
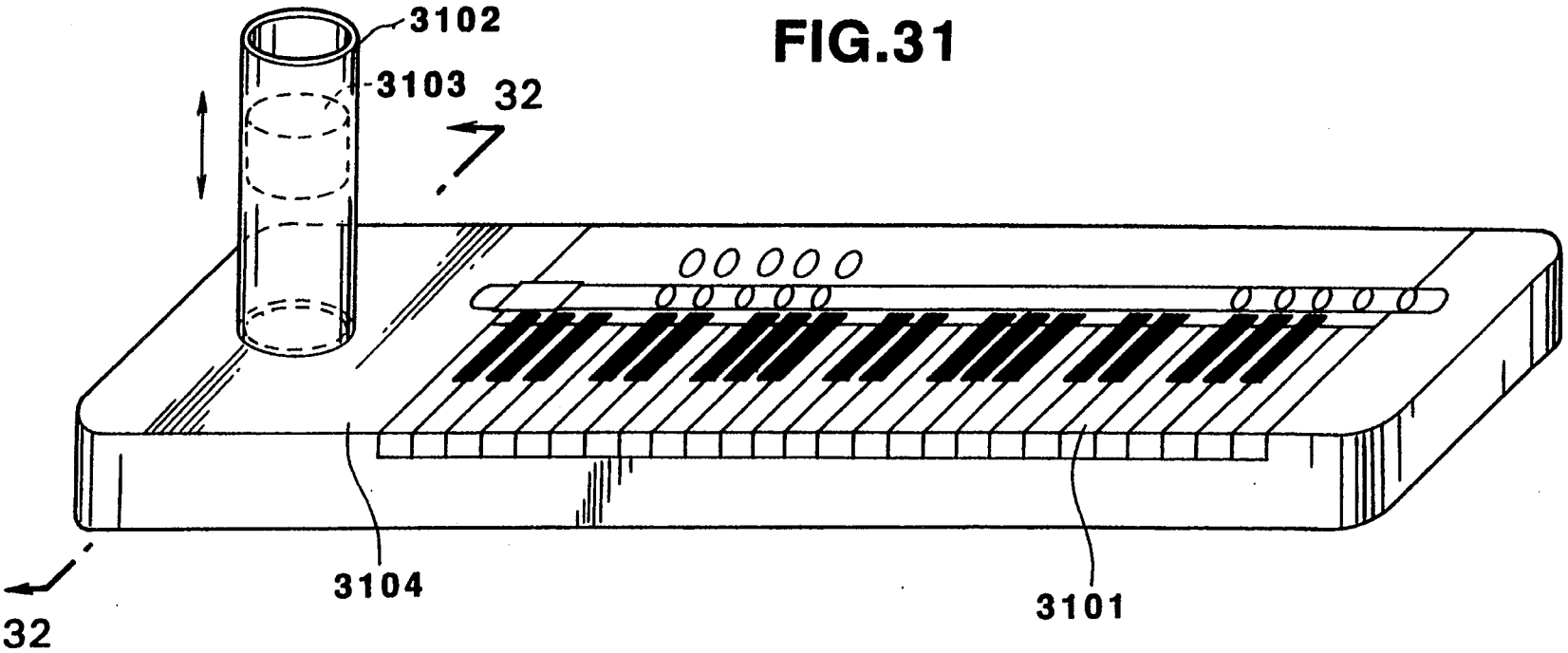
FIG. 31 shows the appearance of a sixteenth embodiment.

FIG. 31 shows the appearance of the present embodiment where keyboard 3101 has 44 keys (F2–C6).

Figure 32:
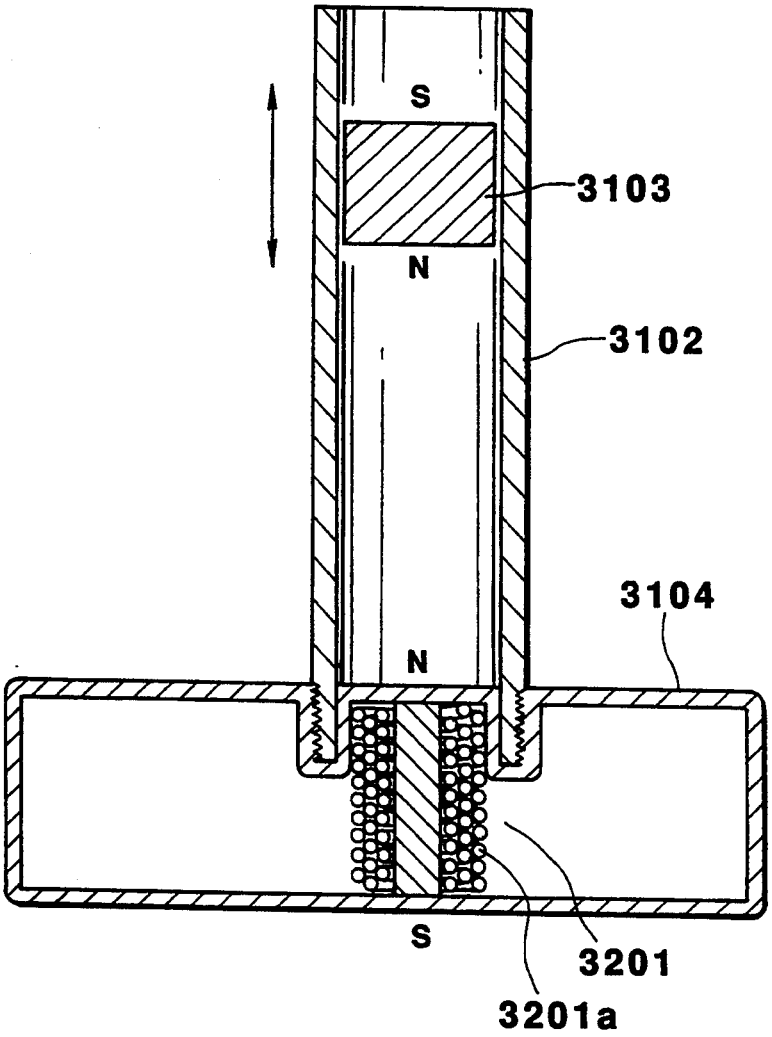
FIG. 32 is a cross-sectional view taken along the line 32—32 of FIG. 31.

In FIG. 31, cabinet 3104 of an the electronic keyboard instrument is provided with solenoid 3201 and magnet 3103 put in transparent case 3102 as shown in a cross-sectional view of FIG. 32. Magnet 3103 has polarities which repel magnetic polarities produced when a current flows through solenoid 3201.

In this case, the height to which magnet 3103 is repelled and pushed up by solenoid 3201 changes depending on a current flowing through solenoid coils **3201*a*** in a predetermined range.

Figure 35:
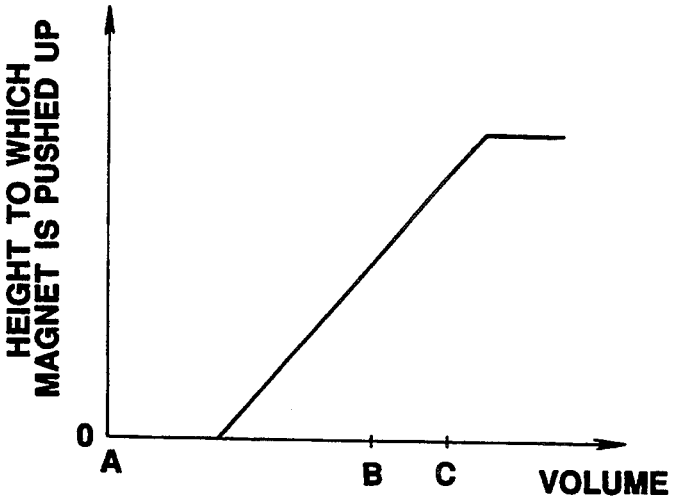
FIG. 35 shows the relationship between volume of a tone performed and height to which the magnet is pushed up.

If the current flowing through coils **3201*a* is controlled on the basis of a change in the volume of a tone performed, for example, on keyboard 3101, magnet 3103 is repelled in accordance with a characteristic, for example, shown in FIG. 35, so that the height to which magnet 3103 is pushed up changes. In FIG. 35, the magnet is not yet pushed up at volume A, but as the volume increases, the magnet starts to be pushed up. As the volume increases as shown by B and C in FIG. 35, the height to which the magnet is pushed up increases. As the distance between the solenoid and the magnet increases, the height to which the magnet is pushed up is saturated at a predetermined height, as shown in FIG. 35**.

Figure 33:
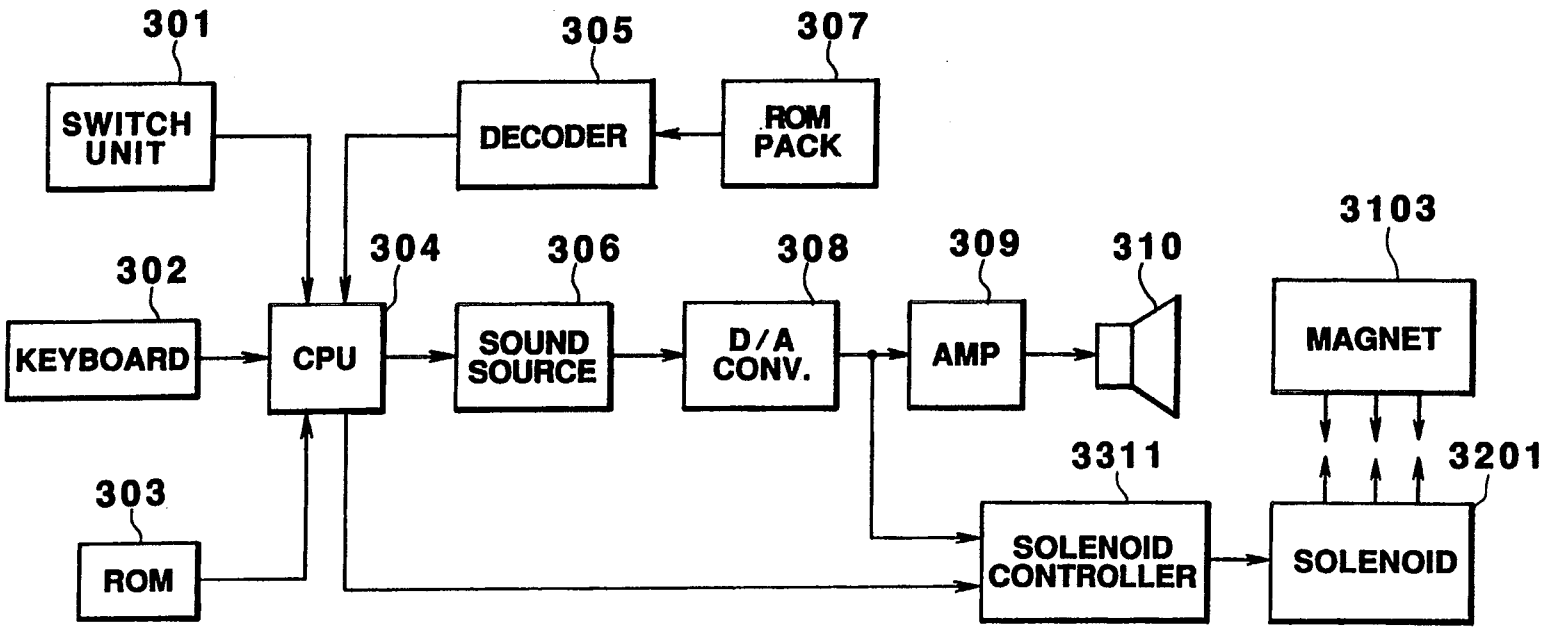
FIG. 33 shows the overall structure of the sixteenth embodiment.

FIG. 33 is a block diagram indicative of the overall structure of the present embodiment. The structure of the embodiment of FIG. 33 is substantially the same as that of the FIG. 3 first embodiment, and the same reference numeral in FIGS. 33 and 3 denotes elements having the same function.

In FIG. 33, solenoid controller 3311 controls a current flowing through solenoid 3201 in accordance with the amplitude envelope of the tone signal from D/A converter 308 or the volume of the tone. As a result, magnet 3103 is pushed up in accordance with the intensity of the magnetic field produced by solenoid 3201 depending on the magnitude of the current. In this case, the user can adjust the height to which magnet 3103 is pushed up, with a knob on switch unit 301, as described below.

Figure 34:
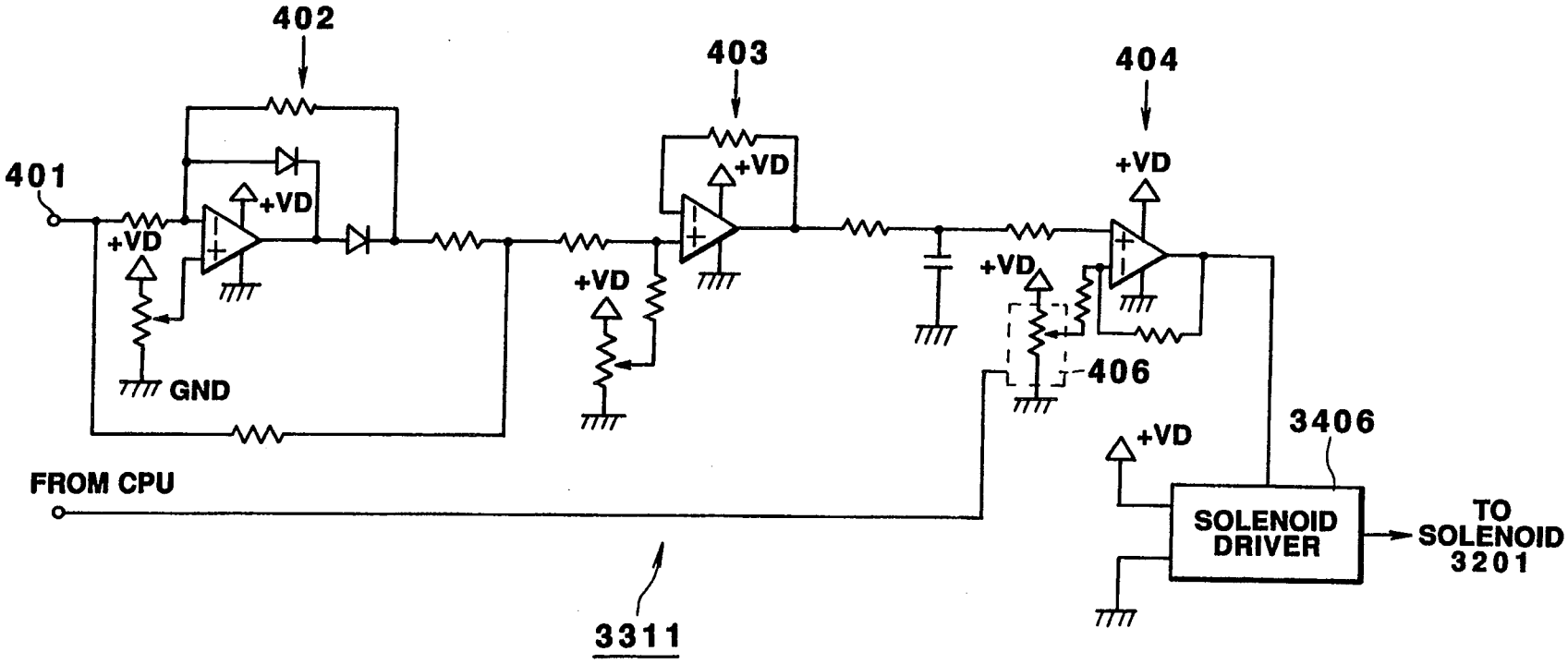
FIG. 34 is a circuit diagram of a solenoid of the sixteenth embodiment.

The circuit of solenoid controller 3311 is shown in FIG. 34, and is substantially the same in structure as that of motor controller 311 of the FIG. 4 first embodiment. The same reference numeral in FIGS. 34 and 4 denote elements having the same function. The DC output from DC amplifier 404 is converted by solenoid driver comprising a power amplifier 3406 to a current output, which is fed to solenoid 3201.

In this case, the height to which magnet 3103 is repelled to be pushed up by solenoid 3201 is required to be adjusted. To this end, when the user adjusts a particular knob on switch unit 301 of FIG. 33, CPU 304 feeds a control voltage corresponding to the quantity of manipulation of the knob to electronic variable resistor 405 connected to DC amplifier 404 to thereby control an offset voltage in DC amplifier 404 to adjust a voltage input to solenoid driver 3406.

<Operation>

By the above structure, the value of the current flowing through solenoid 3201 changes in accordance with the amplitude envelope of the tone signal from tone source 306 or the volume of the tone on the basis of performance data from keyboard 302 or ROM pack 307 of FIG. 33.

As a result, as described above, when the volume of the tone is larger, magnet 3103 is higher pushed up while the volume is smaller, the magnet is lower pushed up.

While the sixteenth embodiment of the present invention has been described above, the present invention is not necessarily required to be combined with a musical instrument. As will be described in the next seventeenth embodiment, an interior device can be realized in which the height to which, for example, a plurality of small magnets is pushed up changes in accordance with a characteristic, for example, volume, of a tone produced by an automatic performance apparatus such as a sequencer.

Seventeenth Embodiment

The present embodiment is the same in appearance, overall structure, solenoid controller, etc., except for a cross-sectional view of FIG. 32.

<Structure>

Figure 36:
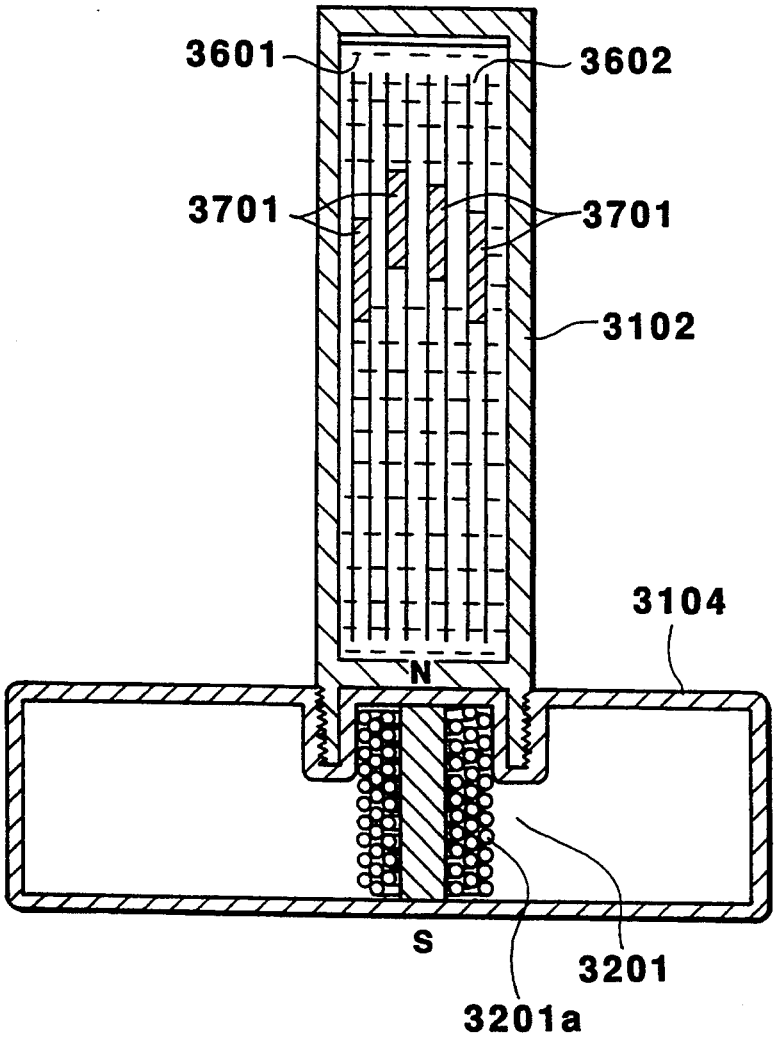
FIG. 36 is a cross-sectional view of a seventeenth embodiment corresponding to the cross-sectional view of the sixteenth embodiment of FIG. 32.

FIG. 36 is a cross-sectional view of the seventeenth embodiment corresponding to that of the FIG. 32 sixteenth embodiment.

In FIG. 36, a plurality of transparent tubes 3602 with open ends is provided within a transparent case 3102 with the tubes being fixed at upper and lower ends to the corresponding holders (not shown). Transparent case 3102 and tubes 3602 are each filled with a transparent liquid 360. Disposed at the bottom of transparent tubes 3602 are corresponding capsules 3701 each having the appearance shown in FIG. 37A and containing magnet 3103 having a cross-sectional view of FIG. 37B.

Magnet 3103 has polarities repelled by polarities produced when a current flows through solenoid 3201.

<Operation>

By the above structure, the value of a current flowing through solenoid 3201 changes in accordance with the amplitude envelope of a tone signal from tone source 306 or the volume of the tone on the basis of performance data from keyboard 302 due to the performance by the performer or ROM pack 307.

Figure 37A:
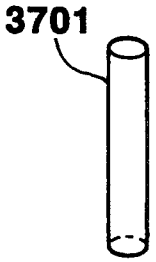
FIGS. 37A and B are a view of the appearance and a cross-sectional view, respectively, of a capsule of a seventeenth embodiment.
Figure 37B:
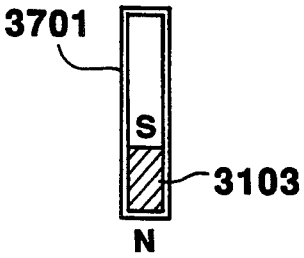

As a result, capsules 3701 are higher pushed up when the volume is larger while they are lower pushed up when the volume is smaller, depending on the repelling force between magnets 3103 disposed at the bottoms of capsules 3701 and the magnetic polarities of solenoid 3201, as shown in FIGS. 37A and B.

In the sixteenth embodiment, magnet 3103 is directly put in the transparent case, so that magnet 3103 moves rapidly up and down in direct accordance with a change in the volume of the tone while in the present embodiment the moves of capsules 3701 are not rapid as in the sixteenth embodiment because of the form drag of capsule 3701 and viscous drag of transparent liquid 360, and the capsules drop slowly in several seconds even when the volume of the tone decreases rapidly.

The use of different gaps between the inner wall of tubes 3602 and capsules 3701, different weights and capacities of capsules 3701, different magnetomotive forces of magnets 3103, etc., will result in different individual moves of capsules 3701.

While four straight transparent tubes 3602 are depicted in FIG. 36, the present invention is not limited to the use of them. For example, many (for example, about 20) curved finely curled thin transparent tubes may be used to move capsules different in shape, dimension or color at various speeds depending on the volume of a tone within the transparent tubes to realize an interior device of a new sense.

Eighteenth Embodiment

<structure>

Figure 38:
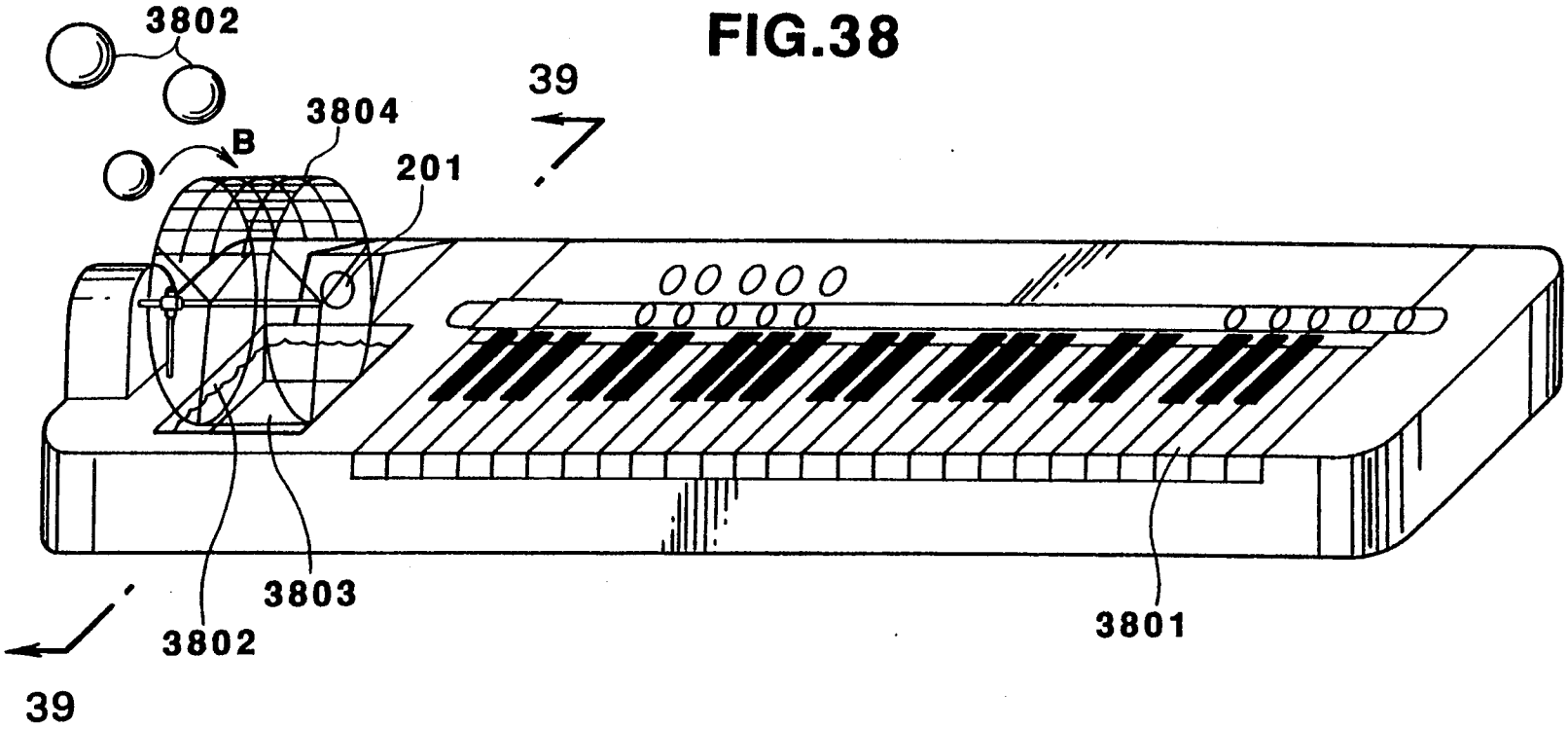
FIG. 38 shows the appearance of an eighteenth embodiment.

FIG. 38 shows the appearance of the present embodiment with keyboard 3801 having 44 keys (F2–C6).

Figure 39:
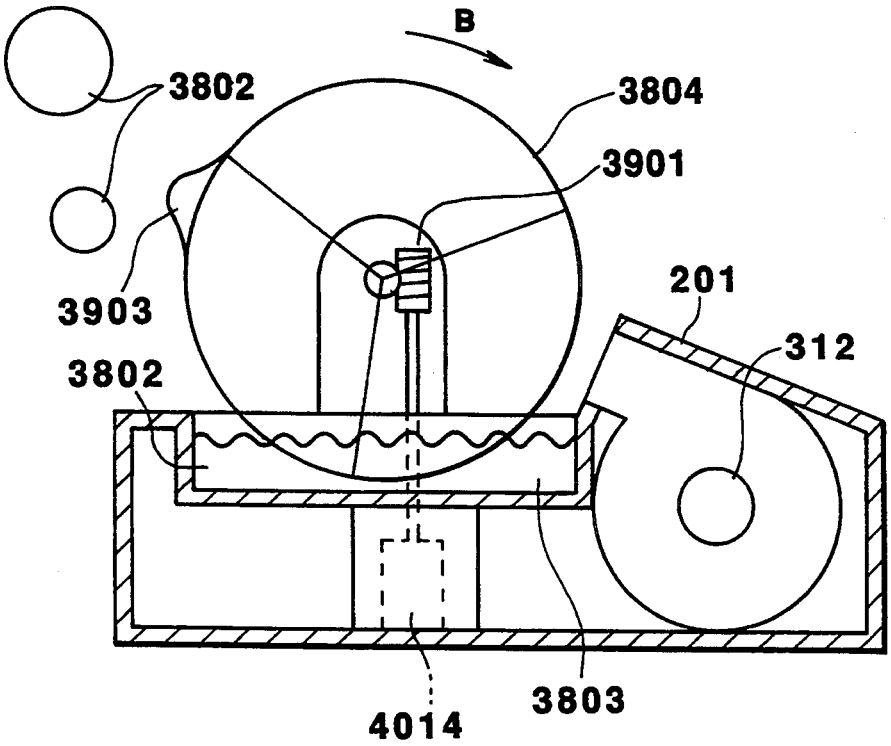
FIG. 39 is a cross-sectional view taken along the line 39—39 of FIG. 38.

In FIG. 38, an electronic keyboard instrument has a concavity 3803 shown in FIG. 39 which is a cross-sectional view taken along the line 39—39 of FIG. 38, and filled with a highly viscous liquid such as soap water 3802. A metal net cylinder 3804 (see FIG. 38) is rotated in the direction of arrow B by motor 4014 through a worm 3901 while being partially dipped in soap water 3802. When fan 202 rotated by blower motor 312 similar to that of the first embodiment of FIGS. 2A and B feeds an air blast to duct 201, soap water films 3903 sticking to net cylinder 3804 are sequentially moved away from net cylinder 3804 while being curved. In this way, soap bubbles 3802 are successively produced.

In this case, as the rotational speeds of net cylinder rotating motor 4014 and blower motor 312 increase, the number of soap bubbles 3802 produced in a unit time increases while if they decrease, the size of soap bubbles 3802 produced increase. The height to and distance through which soap bubbles 3802 are blown up increase as the pressure of air blast from duct 201 increases.

If the rotational speed of net cylinder rotating motor 4014 and the pressure of air blast from blower motor 312 are controlled on the basis of a change in the characteristic, for example, volume, of a tone performed by keyboard 3801, the number of soap bubbles 3802 produced in a unit time, the size of soap bubbles 3802 and the heights to which the bubbles are blown up can be changed in accordance with the change in the volume of the tone.

Figure 42A:
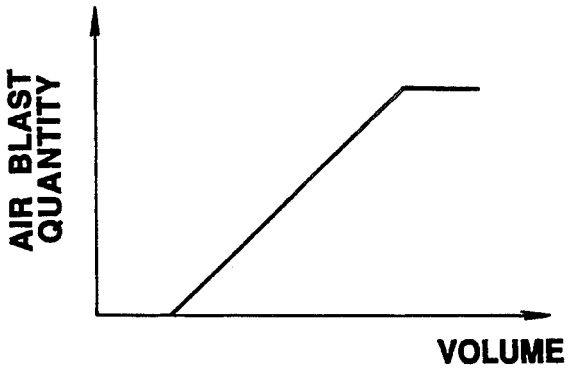
FIGS. 42A–C show the relationship between the volume of a tone performed, an air blast quantity in duct 201, the rotational speed of metal net cylinder 3804 and the number of soap bubbles produced in a unlit time.
Figure 42B:
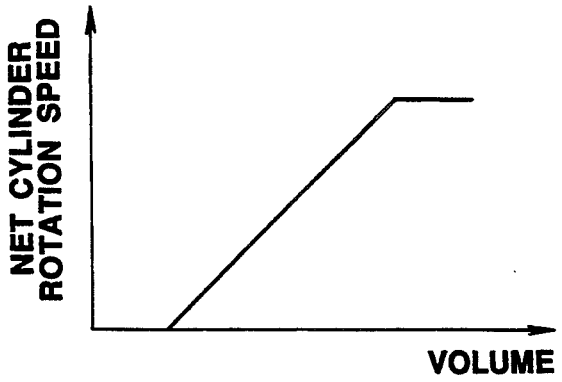
Figure 42C:
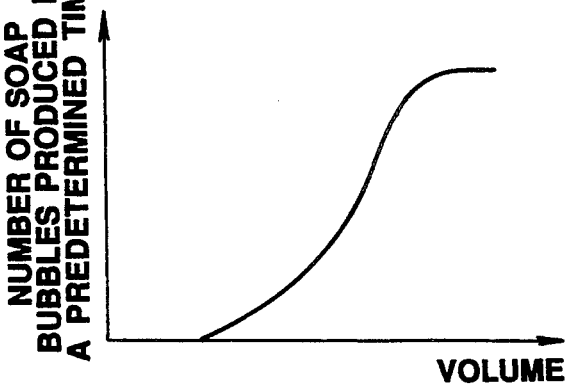

FIGS. 42A–C show a characteristic illustrative of the operation of the present embodiment. When a quantity of air blast from duct 201 and the rotational speed of metal net cylinder 3804 are changed as shown in FIGS. 40A and B in accordance with the volume of the performed tone, the number of soap bubbles 3802 produced in a unit time changes as shown in FIG. 42C.

Figure 40:
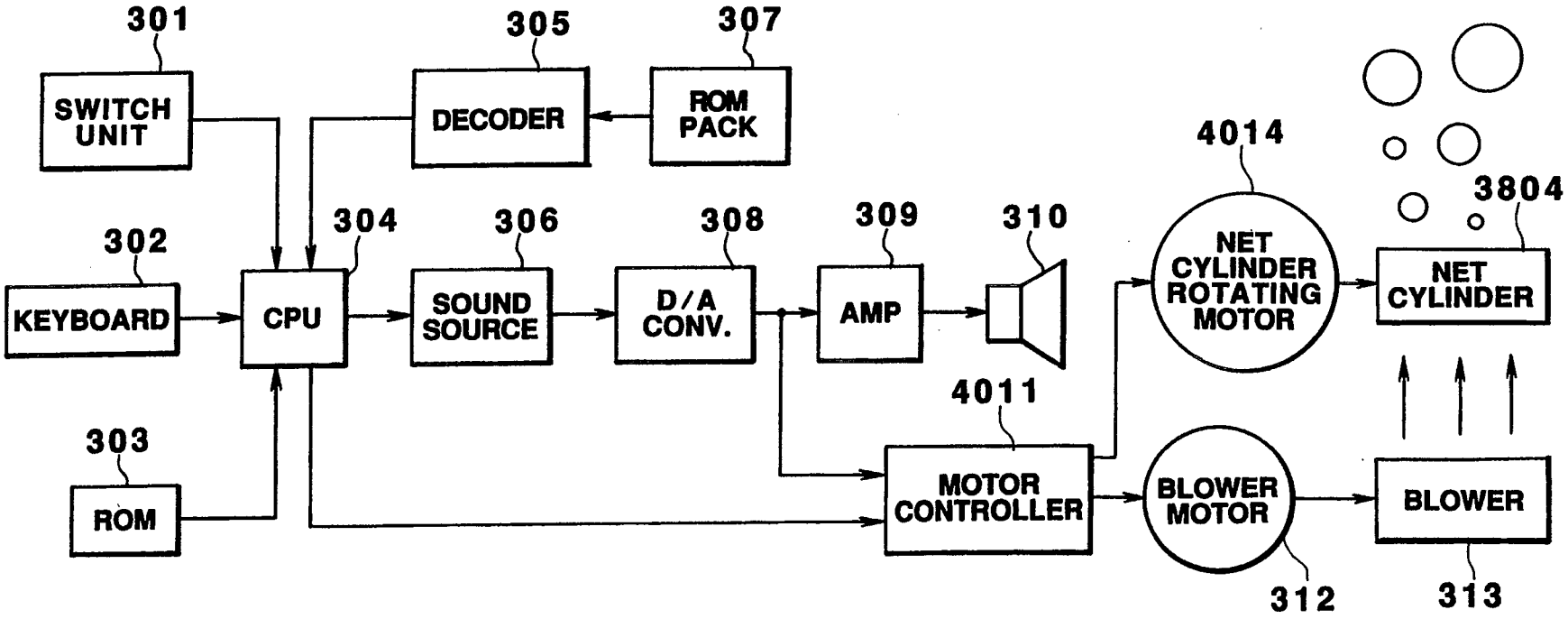
FIG. 40 shows the overall structure of the eighteenth embodiment.

FIG. 40 is a block diagram indicative of the overall structure of the present embodiment. The structure of the present embodiment is substantially the same as that of FIG. 3 first embodiment. The same reference numeral in FIGS. 40 and 3 denotes elements having the same function.

In FIG. 40, at the same time when a tone is generated through speaker 310, motor controller 4011 controls the rotational speed of blower motor 312 and net cylinder rotating motor 4014 in accordance with the amplitude of the envelope of the tone signal from D/A converter 308 or the volume of the tone.

In this way, soap bubbles 3802 are blown up from metal net cylinder 3804 to which soap water 3802 adheres, as mentioned above. In this case, the user can adjust the size of soap bubbles, the number of soap bubbles 3802 produced in a unit time and the heights to which the bubbles are blown up by adjusting the knob on the switch unit 301, as described below.

Figure 41:
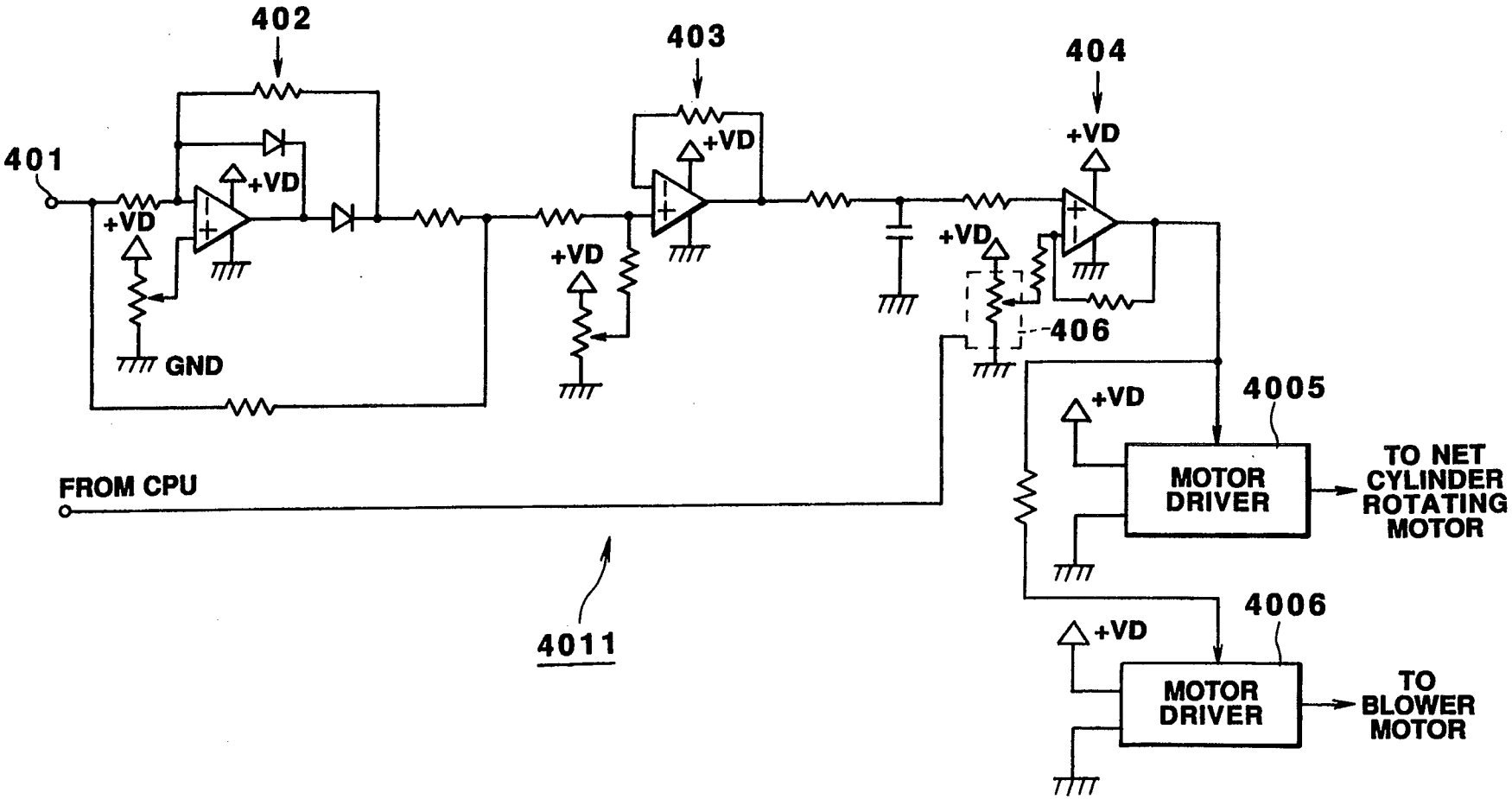
FIG. 41 is a circuit diagram of a motor controller of the eighteenth embodiment.

The circuit of motor controller 4011 of the present embodiment is shown in FIG. 41 and substantially similar to that of motor controller 311 of the FIG. 4 first embodiment. The same reference numeral in FIGS. 41 and 4 denotes elements having the same function.

In FIG. 4, the DC voltage output from DC amplifier 404 is power amplified by motor drivers 4005 and 4006 each comprising a power amplifier, the outputs of which are fed to net cylinder rotating and blower motors 4014 and 312, respectively.

In this case, in order to adjust the size of soap bubbles, the number of soap bubbles 3802 produced in a unit time or the heights to which the soap bubbles 3802 are blown up, the pressure of air blast from blower 313 (duct 201) and the rotation of net cylinder 3804 are required to be adjusted. To this end, when the user adjusts the particular knob on switch unit 301 of FIG. 40, CPU 304 delivers a control voltage corresponding to the quantity of manipulation of the knob to electronic variable resister 406 connected to DC amplifier 404 to thereby control an offset voltage in DC amplifier 404 and the input voltages to motor drivers 4005 and 4006.

<Operation>

By the above structure, the rotational speeds of blower motor 312 and net cylinder rotating motor 4014 change in accordance with the amplitude envelope of the tone signal from tone source 306 or the volume of the tone on the basis of performance data from keyboard 302 or ROM pack 307.

As a result, as mentioned above, the number of soap bubbles 3802 produced in a unit time changes in accordance with an increase in the volume of the tone, and soap bubbles 3802 are higher blown up when the volume of the tone is larger while they are lower blown up when the tone volume is smaller.

While in the present embodiment the two motor drivers 4005 and 4006 are controlled in accordance with a set of DC amplifier 404 and electronic variable resistor 406, motor drivers 4005 and 4006 may be controlled by corresponding separate DC amplifiers and electronic variable resisters. In this case, by controlling the two variable resisters by the corresponding two particular knobs on the switch unit 301 of FIG. 40, the state of production of soap bubbles or the size, number of soap bubbles produced in a unit time and the height to which the soap bubbles are blown up can be controlled.

While in the present embodiment the rotational speed of blower motor 312 is illustrated as being changed in accordance with the volume of the tone, the time duration of rotation of blower 312 may be controlled in accordance with the volume of the tone.

Soap bubble solution films may be produced, for example, with a ring of wire in addition to the metal net cylinder.

In addition, the electronic musical instruments to which the present invention is applied are not limited to the electronic keyboard instruments, but may be wind instruments, for example.

In addition, the present invention is not necessarily required to be combined with musical instruments. For example, the present invention can be realized as an interior device which the state of production of soap bubbles changes depending on performance data produced from an automatic performance apparatus such as a sequencer.

Other Embodiments

While in the eighth embodiment the height to which the ball is blown up is changed in accordance with a combination of timbre data and pitch data, arrangement may be such that the height to which the ball is blown up is changed on the basis of any combination of some or all of those data, other data on volume, velocity, rhythm pattern, tempo, and pitch change.

Alternatively, arrangement may be such that the height to which the ball is blown up is changed depending on other performance data.

While in the ninth embodiment the offset voltage applied to the motor is illustrated as being automatically adjusted in accordance with the current form of performance such as manual performance, automatic performance or demonstration performance, automatic performance may be performed depending on the current selected timbre or an effect adding function and not on the current form of performance.

In the thirteenth embodiment, other effect adding devices such as a distortion circuit may be used in place of echo unit 2601.

In the fourteenth embodiment, a metal net cylinder case other than the transparent cylinder case may be used. The shape of the case is limited to a cylindrical one.

The objects which are blown up may be various light ones other than the balls and put in the glass cylinder.

The direction in which the object is moved is not limited to a vertical one, but may be a horizontal one.

In addition, the electronic musical instruments to which the present invention is applied are not limited to electronic keyboard instruments, and may be wind instruments, for example.

In addition, the music representing apparatus and process according to the present invention is not necessarily required to be combined with musical instruments. The present invention may be realized for example, as an interior device in which the height to which the ball is blown up changes depending on performance data produced from an automatic performance device such as a sequencer, an acoustic signal from a television or a radio set or a reproduced signal from a compact disk or a cassette tape.

A combination of any one of the sixteenth–eighteenth embodiments and any one of the second–thirteenth and fifteenth embodiments may produce effective musical effects.

While several embodiments of the present invention have been above described in detail, they are only illustrative and the present invention may take other various structures. Thus, all other changes and modifications of the present invention fall within the scope of the present invention, and the scope of the present invention should be determined only by the appended claims and their equivalents.

What is claimed is:

1. A music representing apparatus comprising:

input means for inputting performance data;

tone generating means for generating a tone signal on the basis of the performance data;

an object;

object driving means for applying a force to said object to float said object over the object driving means; and control means for controlling said object driving means to vary the force applied to said object on the basis of at least one of the performance data and the tone signal generated by said tone generating means.

2. A music representing apparatus according to claim 1, wherein:

said object driving means includes means for applying an air blast to said object; and said control means controls said object driving means to vary the air blast applied to said object on the basis of at least one of the performance data and the tone signal generated by said tone generating means.

3. A music representing apparatus according to claim 2, wherein:

said object driving means comprises electrical drive means for applying the air blast to said object;

a signal representing a drive state of the electrical drive means is fed back to the control means; and said control means controls said electrical drive means to vary the air blast applied to said object on the basis of both the tone signal and the signal representing the drive state of said electrical drive means.

4. A music representing apparatus according to claim 3, further comprising:

drive speed detecting means for detecting a drive speed of said electrical drive means; and wherein:

the signal representing the drive state of said electrical drive means which is detected by said drive speed detecting means.

5. A music representing apparatus according to claim 1, wherein:

said object comprises a magnetized object;

said object driving means includes means for applying a magnetic force to said object; and said control means controls said object driving means to vary the magnetic force applied to said object on the basis of at least one of the performance data and the tone signal generated by said tone generated means.

6. A music representing apparatus according to claim 5, wherein said object driving means comprises an electromagnetic solenoid which includes coils, and which applies said magnetic force when an electric current flows through the coils of said solenoid.

7. A music representing apparatus according to claim 1, wherein:

said control means controls said object driving means to vary the force applied to said object in accordance with a volume of the tone signal.

8. A music representing apparatus according to claim 1, wherein the performance data inputted by said input means comprises at least one of data items on a pitch of the tone signals, a velocity indicative of a strength of key depression, a timbre of the tone signals, a pitch bend indicative of a change in the pitch of the tone signal, and designation of a form of performance.

9. A music representing apparatus according to claim 1, wherein said input means comprises automatic performance means for automatically generating the performance data.

10. A music representing apparatus according to claim 9, wherein the performance data is generated by automatic performance means, and the performance data comprises at least one of data items on a pitch of the tone signal, a velocity indicative of a strength of a key depression, a timbre of the tone signal, a pitch bend indicative of a change in the pitch of the tone signal, designation of a form of performance, a rhythm pattern controlled by the automatically generated data, and a tempo of an automatic performance controlled by the automatically generated data.

11. A music representing apparatus according to claim 1, further comprising:

envelope extracting means for extracting an envelope of the tone signal which said tone generating means generates; and wherein:

said control means controls the object driving means such that said object driving means applies the force to said object in a predetermined direction when the envelope extracted by said envelope extracting means is larger than a predetermined value, and said object driving means applies the force to said object in a direction opposite to said predetermined direction when said envelope extracted by said envelope extracting means is smaller than the predetermined value.

12. A music representing apparatus according to claim 1, further comprising:

effect adding means for adding a predetermined effect to the tone signal which said tone generating means generates; and wherein:

said control means controls said object driving means to vary the force applied to said object on the basis of the tone signal to which the effect has been added by said effect adding means.

13. A music representing apparatus according to claim 1, wherein said input means comprises performance means for generating the performance data by performance.

14. A music representing apparatus according to claim 1, further comprising guide means for determining an orbit of said object such that said object is movable along a predetermined orbit.

15. A music representing apparatus comprising:

an object;

object driving means for applying a force to said object to float said object over the object driving means;

receiving means for receiving at least one of performance data and an acoustic signal as a control signal; and control means for controlling said object driving means to vary the force applied to said object on the basis of the control signal.

16. A music representing apparatus according to claim 15, wherein:

said object driving means includes means for applying an air blast to said object; and said control means controls said object driving means to vary the air blast applied to said object on the basis of the control signal.

17. A music representing apparatus according to claim 15, wherein:

said object comprises a magnetized object;

said object driving means includes means for applying a magnetic force to said object; and said control means controls said object driving means to vary the magnetic force applied to said object on the basis of the control signal.

18. A music representing apparatus, comprising:

an electronic musical instrument for outputting at least one of performance data and an acoustic signal as a control signal;

an object;

object driving means for applying a force to said object to float said object over the object driving means; and control means for controlling said object driving means to vary the force applied to said object on the basis of the control signal output from said electronic musical instrument.

19. A music representing apparatus according to claim 18, wherein:

said object driving means includes means for applying an air blast to said object; and said control means controls said object driving means to vary the air blast applied to said object on the basis of the control signal output from said electronic musical instrument.

20. A music representing apparatus according to claim 18, wherein:

said object comprises a magnetized object;

said object driving means includes means for applying a magnetic force to said object; and said control means controls said object driving means to vary the magnetic force applied to said object on the basis of at least one of performance data and an acoustic signal output as said control signal by said electronic musical instrument.

21. In a music representing apparatus including an object floating unit for floating an object over the object floating unit, a music representing process comprising the steps of:

inputting performance data;

generating a tone signal on the basis of input performance data;

applying a force to said object to float said object over the object floating unit; and controlling the force to be applied to said object on the basis of at least one of the inputted performance data and the generated tone signal.

22. In a music representing apparatus including an object floating unit for floating an object over the object floating unit, a music representing process comprising the steps of:

applying a force to said object to float said object over the object floating unit;

receiving at least one of performance data and an acoustic signal as a control signal; and controlling the force to be applied to the object on the basis of the control signal.

* * * * *